US010973725B2

(12) United States Patent
Mason et al.

(10) Patent No.: US 10,973,725 B2
(45) Date of Patent: Apr. 13, 2021

(54) CHAIR

(71) Applicant: FLEXIBOD LIMITED, County Clare (IE)

(72) Inventors: Damien Gerard Mason, Sheaun (IE); James Robert Lynch, Brennanstown (IE); Mathew Gill Bates, Deans Grange (IE)

(73) Assignee: Flexibod Limited, County Clare (IE)

( * ) Notice: Subject to any disclaimer, the term of this patent is extended or adjusted under 35 U.S.C. 154(b) by 31 days.

(21) Appl. No.: 16/093,381

(22) PCT Filed: Apr. 13, 2017

(86) PCT No.: PCT/IE2017/000007
§ 371 (c)(1),
(2) Date: Oct. 12, 2018

(87) PCT Pub. No.: WO2017/179034
PCT Pub. Date: Oct. 19, 2017

(65) Prior Publication Data

US 2019/0125609 A1 May 2, 2019

(30) Foreign Application Priority Data

Apr. 13, 2016 (IE) ..... S2016/0104

(51) Int. Cl.
*A61H 1/02* (2006.01)
*A63B 21/005* (2006.01)
(Continued)

(52) U.S. Cl.
CPC ..... *A61H 1/0244* (2013.01); *A47C 1/024* (2013.01); *A47C 1/03* (2013.01); *A47C 1/034* (2013.01);
(Continued)

(58) Field of Classification Search
CPC ..... A61H 1/0244; A61H 2201/164; A61H 1/024; A61H 1/0255; A61H 1/0266;
(Continued)

(56) References Cited

U.S. PATENT DOCUMENTS 4,607,882 A * 8/1986 Opsvik ..... A47C 7/029 297/195.11
4,650,249 A * 3/1987 Serber ..... A47C 9/005 297/313
(Continued)

FOREIGN PATENT DOCUMENTS

DE 7914591 U1 9/1979
EP 1 208 830 A2 5/2002
(Continued)

OTHER PUBLICATIONS

International Search Report of PCT/IE2017/000007 dated Sep. 28, 2017 [PCT/ISA/210].
(Continued)

*Primary Examiner* — Garrett K Atkinson
(74) *Attorney, Agent, or Firm* — Sughrue Mion, PLLC

(57) ABSTRACT

A chair includes a seat (2) and also includes a pair of thigh support elements (17) pivotal n a generally downwardly direction about front pivot axes (20) from a first state forming with a central seat element (15) a substantially common plane, to a second downwardly extending state. The elements (17) are also pivotal about second pivot axes in a generally rearwardly direction for urging the user's thighs away from each other for stretching the adductor muscles. Foot support members (49) extend transversely and sidewardly on respective opposite sides of the chair (1) from a support element (46) for supporting the foot during a stretching exercise with the corresponding thigh of the subject extending downwardly from the seat (14) and the lower leg extending from the knee in a upwardly inclined
(Continued)

direction to the foot support member (49) for stretching the quadriceps and the hip flexor muscles of the subject.

24 Claims, 11 Drawing Sheets

(51) Int. Cl.

| | |
|---|---|
| ***A63B 21/008*** | (2006.01) |
| ***A63B 21/02*** | (2006.01) |
| ***A63B 23/04*** | (2006.01) |
| ***A47C 9/00*** | (2006.01) |
| ***A47C 1/034*** | (2006.01) |
| ***A47C 7/02*** | (2006.01) |
| ***A47C 1/03*** | (2006.01) |
| ***A47C 1/024*** | (2006.01) |
| ***A47C 9/02*** | (2006.01) |
| ***A47C 16/02*** | (2006.01) |
| ***A47C 7/54*** | (2006.01) |
| ***A47C 7/50*** | (2006.01) |
| ***A63B 23/00*** | (2006.01) |

(52) U.S. Cl.
CPC ..... *A47C 7/024* (2013.01); *A47C 7/503* (2013.01); *A47C 7/5066* (2018.08); *A47C 7/541* (2018.08); *A47C 9/002* (2013.01); *A47C 9/005* (2013.01); *A47C 9/025* (2013.01); *A47C 16/025* (2013.01); *A61H 1/024* (2013.01); *A61H 1/0255* (2013.01); *A61H 1/0266* (2013.01); *A63B 21/0058* (2013.01); *A63B 21/0085* (2013.01); *A63B 21/023* (2013.01); *A63B 23/0482* (2013.01); *A61H 2001/0248* (2013.01); *A61H 2201/0149* (2013.01); *A61H 2201/0192* (2013.01); *A61H 2201/1215* (2013.01); *A61H 2201/1445* (2013.01); *A61H 2201/164* (2013.01); *A61H 2201/1623* (2013.01); *A61H 2201/1633* (2013.01); *A61H 2203/0431* (2013.01); *A63B 21/008* (2013.01); *A63B 2023/006* (2013.01); *A63B 2208/0233* (2013.01); *A63B 2210/02* (2013.01); *A63B 2225/09* (2013.01); *A63B 2225/093* (2013.01)

(58) Field of Classification Search
CPC .... A61H 2201/1445; A61H 2201/0149; A61H 2203/0431; A61H 2201/1215; A61H 2001/0248; A61H 2201/0192; A61H 2201/1623; A61H 2201/1633; A47C 7/541; A47C 9/002; A47C 1/034; A47C 7/024; A47C 1/03; A47C 1/024; A47C 9/005; A47C 9/025; A47C 16/025; A47C 7/5066; A47C 7/503; A63B 21/0058; A63B 21/0085; A63B 21/023; A63B 23/0482; A63B 21/008; A63B 2023/006; A63B 2208/0233; A63B 2210/02; A63B 2225/09; A63B 2225/093
See application file for complete search history.

(56) References Cited

U.S. PATENT DOCUMENTS

D289,708 S 5/1987 Rykken
4,832,407 A * 5/1989 Serber ..... A47C 7/506 297/300.3
D309,531 S 7/1990 Dozsa-Farkas
5,295,936 A * 3/1994 Perry, Jr. ..... A63B 21/00047 482/134
5,401,078 A * 3/1995 Riach ..... A47C 7/503 297/19
D369,691 S * 5/1996 Haynes ..... D6/335
5,632,710 A * 5/1997 England ..... A63B 23/00 482/127
5,759,138 A * 6/1998 Boland ..... A63B 23/0211 482/122
5,857,747 A * 1/1999 Mundkowski ..... A47C 9/005 297/423.11
5,941,806 A * 8/1999 Olschansky ..... A63B 23/0222 482/132
5,971,485 A * 10/1999 Clark ..... A61G 13/009 297/195.11
6,443,879 B1 * 9/2002 Chen ..... A61H 1/0218 482/143
D472,080 S 3/2003 Kita
6,543,853 B1 * 4/2003 Splane, Jr. ..... A47C 9/005 297/195.11
D479,054 S 9/2003 Chen
6,619,747 B2 * 9/2003 Ko ..... A47C 7/54 248/118.3
6,805,322 B2 * 10/2004 Schmidt ..... B60N 2/0292 244/122 R
6,811,225 B1 * 11/2004 Konya ..... B64D 11/064 297/423.13
6,959,962 B2 * 11/2005 Dixon ..... A61G 7/065 297/195.11
7,070,241 B2 * 7/2006 Saulnier ..... A47C 7/503 297/423.11
7,090,303 B2 * 8/2006 Kropa ..... A47C 7/024 297/201
7,121,629 B2 * 10/2006 Chou ..... A47C 9/002 297/487
7,144,080 B2 * 12/2006 Lloyd ..... A47C 9/005 297/195.11
D547,959 S 8/2007 Adams
7,293,825 B2 * 11/2007 Vergara ..... A47C 9/002 297/1
7,306,289 B2 * 12/2007 Kobayashi ..... A47C 7/503 297/313
D577,933 S 10/2008 Haaksma
7,946,972 B2 * 5/2011 Guissin ..... A47C 1/024 482/142
D648,961 S 11/2011 Rashid
8,052,217 B2 * 11/2011 Toso ..... A47C 3/0252 297/423.12
8,317,267 B2 * 11/2012 Wallace ..... A47C 9/005 297/423.12
D683,149 S 5/2013 Lu
D692,247 S 10/2013 Opsvik
8,764,617 B2 * 7/2014 Teeter ..... A61H 1/0292 482/126
8,905,952 B2 * 12/2014 Berthiaume ..... A61H 1/0218 601/135
9,399,517 B2 * 7/2016 Guering ..... B60N 2/163
D763,588 S 8/2016 Chen et al.
D767,928 S 10/2016 Silvonen
D770,789 S 11/2016 Chen et al.
D774,792 S 12/2016 Haaksma
D777,462 S 1/2017 Haaksma
D777,463 S 1/2017 Haaksma
10,123,930 B2 * 11/2018 McBride ..... A61H 1/0229
D870,478 S 12/2019 Mason et al.
10,517,404 B2 * 12/2019 Hopper ..... A47C 7/543
2004/0245836 A1 * 12/2004 Kropa ..... A47C 7/405 297/423.11
2006/0255643 A1 * 11/2006 Gibson ..... A47C 9/002 297/423.4
2007/0052275 A1 * 3/2007 Ghilzai ..... A47C 1/11 297/423.12
2007/0063569 A1 * 3/2007 Mays ..... A47C 9/005 297/423.12
2007/0281840 A1 * 12/2007 Tsai ..... A63B 23/0211 482/140
2008/0096744 A1 * 4/2008 Perry, Jr. ..... A61H 1/0292 482/144
2009/0140567 A1 * 6/2009 Weiss ..... A47C 7/506 297/423.12

(56) References Cited

U.S. PATENT DOCUMENTS

| | | | | |
|---|---|---|---|---|
| 2011/0012397 | A1* | 1/2011 | Wallace | A47C 9/005 297/195.11 |
| 2013/0119733 | A1 | 5/2013 | White | |
| 2014/0287877 | A1* | 9/2014 | Saghafi | A61H 1/0229 482/13 |
| 2016/0324713 | A1* | 11/2016 | Halperin | A63B 21/00178 |

FOREIGN PATENT DOCUMENTS

| | | | |
|---|---|---|---|
| FR | 2 871 348 | A1 | 12/2005 |
| JP | 2011-224372 | A | 11/2011 |
| KR | 10-0799978 | B1 | 1/2008 |
| KR | 10-1647461 | B1 | 8/2016 |
| WO | 96/10937 | A1 | 4/1996 |
| WO | 2008/085174 | A1 | 7/2008 |
| WO | 2019/073467 | A1 | 4/2019 |

OTHER PUBLICATIONS

Written Opinion of PCT/IE2017/000007 dated Sep. 28, 2017 [PCT/ISA/237].

International Search Report dated Jan. 17, 2019 in PCT/IE2018/000014.

* cited by examiner

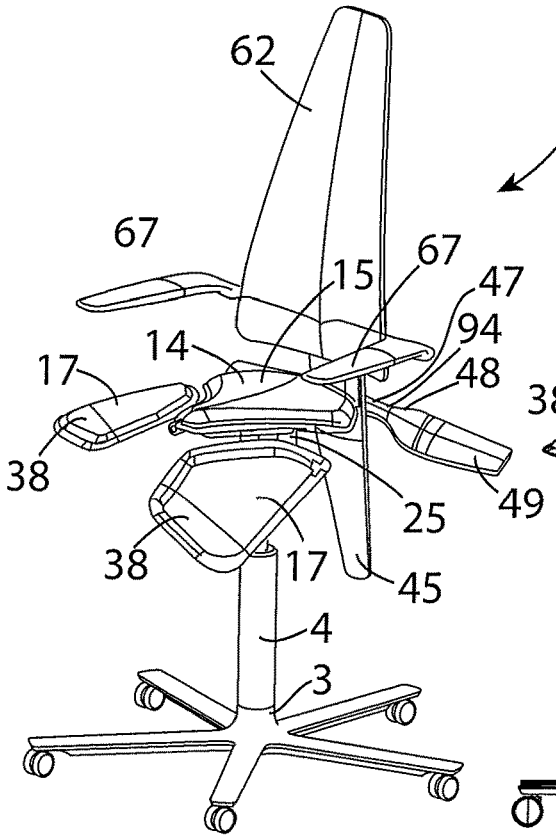
Fig. 19
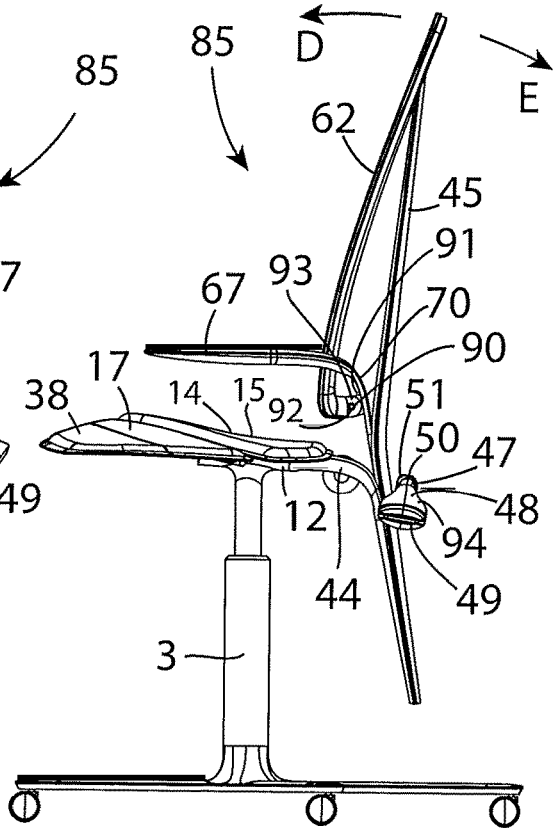
Fig. 20
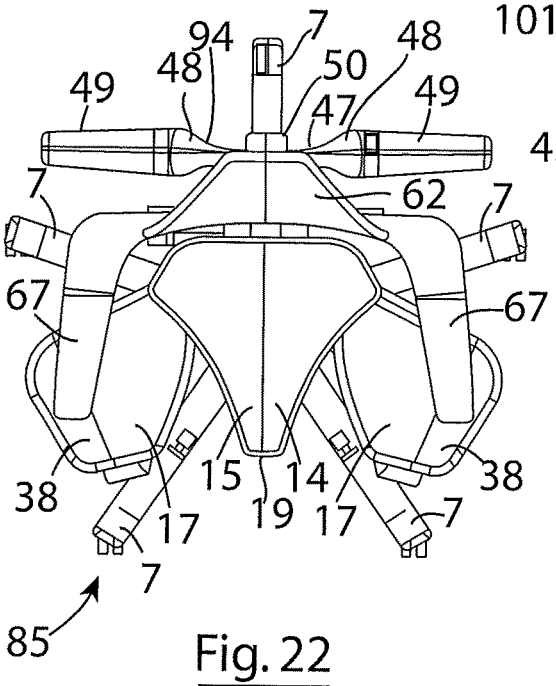
Fig. 22
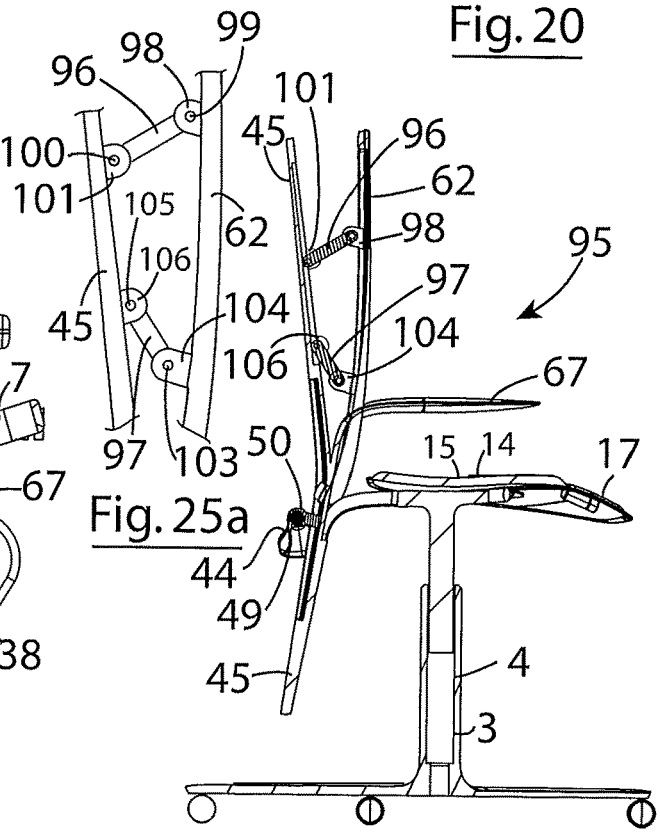
Fig. 25a
Fig. 25

CHAIR

The present invention relates to a chair, and in particular, though not limited to a chair for facilitating the carrying out of stretching exercises by a subject seated on the chair for stretching leg muscles and related muscles as well as other stretches and exercises.

Chairs for stretching muscles of a subject, in particular, leg and related muscles are known. Such chairs tend to be relatively large and particularly cumbersome, and in general, are suitable only for carrying out stretching exercises. They are not suitable as for example, an office chair or the like. Examples of such chairs are disclosed in U.S. Pat. No. 5,626,547 of Davies et al., and while such exercise chairs are suitable for carrying out stretching exercises on leg and other associated muscles of a subject, they are suitable for no other purpose other than carrying out such stretching exercises due to their relatively large and cumbersome construction.

There is therefore a need for a chair which addresses the problems of such known chairs.

The present invention is directed towards providing such a chair.

According to the invention there is provided a chair comprising a ground engaging support, a seat supported on the ground engaging support for engaging the buttocks of a subject seated thereon, and a pair of foot support means located on respective opposite sides of the chair and configured for supporting a corresponding foot or ankle area of a subject seated on the seat with the corresponding thigh of a subject extending generally downwardly towards the knee from the seat and the corresponding lower leg of the subject inclining upwardly from the knee towards the foot support means for stretching of the quadriceps and hip flexor muscles.

A chair comprising a ground engaging support, a seat supported on the ground engaging support for engaging the buttocks of a subject seated thereon, and a pair of foot support means located on respective opposite sides of the chair and configured for supporting a corresponding foot or ankle area of a subject seated on the seat with the corresponding thigh of a subject extending generally downwardly towards the knee from the seat and the corresponding lower leg of the subject inclining upwardly from the knee towards the foot support means for stretching of the quadriceps and hip flexor muscles.

In one aspect of the invention each foot support means is located generally towards the rear of the seat. Preferably, each foot support means is located generally rearwardly of the seat. Advantageously, each foot support means is located to the rear of the seat.

In another aspect of the invention the foot support means are pivotally connected to the chair about a transverse pivot axis, and are pivotal about the transverse pivot axis in a generally forwardly rearwardly direction relative to the seat.

Preferably, the foot support means are adjustably connected to the chair so that the level of the foot support means is adjustable relative to the level of the seat. Preferably, the foot support means are adjustably connected to the chair by an adjustable connecting means. Advantageously, the adjustable connecting means is slideably connected to the chair, and is slideable in a generally upwardly downwardly direction for adjusting the level of the foot support means relative to the level of the seat. Preferably, a first releasable securing means is configured for releasably securing the adjustable connecting means to the chair with the foot support means at a desired level relative to the level of the seat.

In another aspect of the invention a second releasable securing means is provided for releasably securing the foot support means at a desired angular position about the transverse pivot axis.

In one aspect of the invention the level of the foot support means is adjustable relative to the level of the seat between a maximum lower level below the level of the seat and a maximum upper level above the level of the seat. Preferably, the maximum lower level of the foot support means below the level of the seat is approximately 400 mm. Advantageously, the maximum lower level of the foot support means below the level of the seat is approximately 350 mm. Ideally, the maximum lower level of the foot support means below the level of the seat is approximately 300 mm.

Preferably, the maximum upper level of the foot support means above the level of the seat is approximately 100 mm. Advantageously, the maximum upper level of the foot support means above the level of the seat is approximately 125 mm. Preferably, the maximum upper level of the foot support means above the level of the seat is approximately 150 mm.

In another aspect of the invention each foot support means is configured for engaging the instep of the corresponding foot of a seated subject. Preferably, each foot support means comprises a foot support member extending transversely from the corresponding side of the chair. Advantageously, each foot support means comprises an elongated foot support member extending transversely from the corresponding side of the chair.

In one aspect of the invention the foot support means are carried on a carrier element.

Preferably, the foot support means extend from the carrier element on respective opposite sides thereof.

In another aspect of the invention the carrier element is coupled to the chair by the adjustable connecting means.

In a further aspect of the invention a rear support member is located rearwardly of the seat extending in a generally upwardly direction from the ground engaging support.

Preferably, the adjustable connecting means of the foot support means is slideably engageable with the rear support member.

In another aspect of the invention the seat comprises a central seat element, and a pair of thigh support elements coupled to the central seat element and extending outwardly therefrom.

Preferably, the thigh support elements are alignable with the central seat element in a first state with the thigh support elements and the central seat element defining a substantially common plane.

Advantageously, each thigh support element is pivotal relative to the central seat element from the first state about a corresponding substantially horizontal first pivot axis through a downward arc for accommodating the corresponding thigh of a subject seated on the seat during stretching of the corresponding quadriceps and hip flexor muscles.

In another aspect of the invention a first retaining means is provided for retaining each thigh support element in a desired angular position about the corresponding first pivot axis.

Advantageously, a first urging means is provided for urging each thigh support element about the corresponding first pivot axis. Advantageously, each first urging means is configured for urging the corresponding thigh support element in one or both of a generally upwardly direction and a generally downwardly direction.

Preferably, each first urging means comprises a resilient first urging means.

In another aspect of the invention the respective thigh support elements are pivotal about respective substantially vertically extending second pivot axes relative to the central seat element from a rest position through respective arcs in a generally rearwardly direction relative to the central seat element.

Preferably, a second retaining means is provided for retaining each thigh support element in a desired angular position about the corresponding second pivot axis.

Advantageously, a second urging means is provided for urging the thigh support elements about the respective second pivot axes.

In another aspect of the invention the second urging means comprises a rack and pinion drive. Preferably, each thigh support element comprises a corresponding pinion, and the rack of the rack and pinion drive engages the respective pinions for simultaneously urging the thigh support elements about the respective second pivot axes.

In another aspect of the invention the thigh support elements are pivotal relative to the central seat element from the rest position with the respective thigh support elements cooperating with the central seat element to form the seat, in the generally rearwardly direction about the respective second pivot axes for supporting the thighs of a subject seated on the seat for stretching the muscles.

Preferably, the central seat element is of substantially saddle shape having a pair of opposite side edges converging in a generally forwardly direction, and the thigh support elements extend along the respective converging side edges of the central seat element, and extend substantially forwardly therefrom in the rest position.

In another aspect of the invention an inner thigh engaging means is provided on each thigh engaging element for engaging an inner portion of a corresponding thigh supported thereon. Preferably, each inner thigh engaging means is moveable between an inactive state, and an active state engaging an inner portion of a thigh supported on the corresponding thigh support element. Advantageously, each inner thigh engaging means is configured to lie in the plane defined by the corresponding thigh support element in the inactive state. Preferably, each inner thigh engaging means is configured to extend substantially upwardly from the corresponding thigh support element in the active state. Advantageously, each inner thigh engaging means is pivotally coupled to the corresponding thigh support element about a substantially horizontal third pivot axis when the thigh support element is in the datum position, and is pivotal about the third pivot axis between the inactive and the active states. Ideally, each inner thigh engaging means is formed by a distal portion of the corresponding thigh support element.

In one aspect of the invention each inner thigh engaging means comprises an inner thigh engaging element.

In another aspect of the invention a backrest is provided for supporting the back of a subject seated on the seat. Preferably, the backrest extends generally upwardly relative to the seat. Advantageously, the backrest is adjustably coupled to the chair.

In another aspect of the invention the backrest is adjustable upwardly and downwardly relative to the seat. Advantageously, a third releasable securing means is provided for releasably securing the backrest to the chair at a desired level relative to the seat.

In another aspect of the invention the backrest is adjustably coupled to the chair for facilitating adjustment of the angle of the backrest relative to the seat. Preferably, a releasable fixing means is provided for releasably securing the backrest to the chair at a desired angle relative to the seat.

In one aspect of the invention the backrest is coupled to the rear support member.

In another aspect of the invention a pair of armrests are provided on respective opposite sides of the chair. Preferably, the armrests are connected to the rear support member. Advantageously, the armrests are adjustably connected to the rear support member, and are adjustable upwardly and downwardly relative to the level of the seat.

In another aspect of the invention a fourth releasable securing means is provided for releasably securing the armrests at a desired level relative to the seat.

In another aspect of the invention a ground engaging footrest is provided for engaging and supporting one of the feet of a seated subject for facilitating stretching of the glute, hamstring and calf muscles.

The advantages of the invention are many. A particularly important advantage of the invention is that the chair according to the invention which is suitable for carrying out stretching exercises of the leg and associated muscles, is also particularly suited as an office chair, or indeed, a chair for any other use, be it as a dining room chair, or any other such chair which as well as supporting a subject in a seated state, also allows a subject to carry out stretching exercises of leg and associated muscles.

Another advantage of the invention is that the chair allows a person seated thereon to be seated in an neutral pelvis state, in other words, a state in which the pelvis does not tilt unnaturally when both thighs are extending forwardly from the seated subject. Additionally, the chair also allows a seated person seated on the seat to be seated in an neutral pelvis state when one leg is extending forwardly, and the other is extending rearwardly. By having a person seated in a neutral pelvis state on the chair significantly reduces stress in the spine, and in turn back pain. Additionally, by stretching the various leg and associated lower body muscles in the chair according to the invention, the length of the muscles can be maintained at their correct length rather than contracted lengths, which can occur when a person is seated in an unsuitable position in a conventional chair for extended periods of time.

A particularly important advantage of the chair according to the invention is that it permits stretching of the various muscles while, for example, carrying out desk work while seated on the chair. Further, the chair according to the invention permits one to measure their existing range of motion and compare their range of motion to the human norm, and furthermore, to improve their range of motion over time.

The invention will be more clearly understood from the following description of some preferred embodiments thereof which are given by way of example only with reference to the accompanying drawings, in which.

Figure 1:
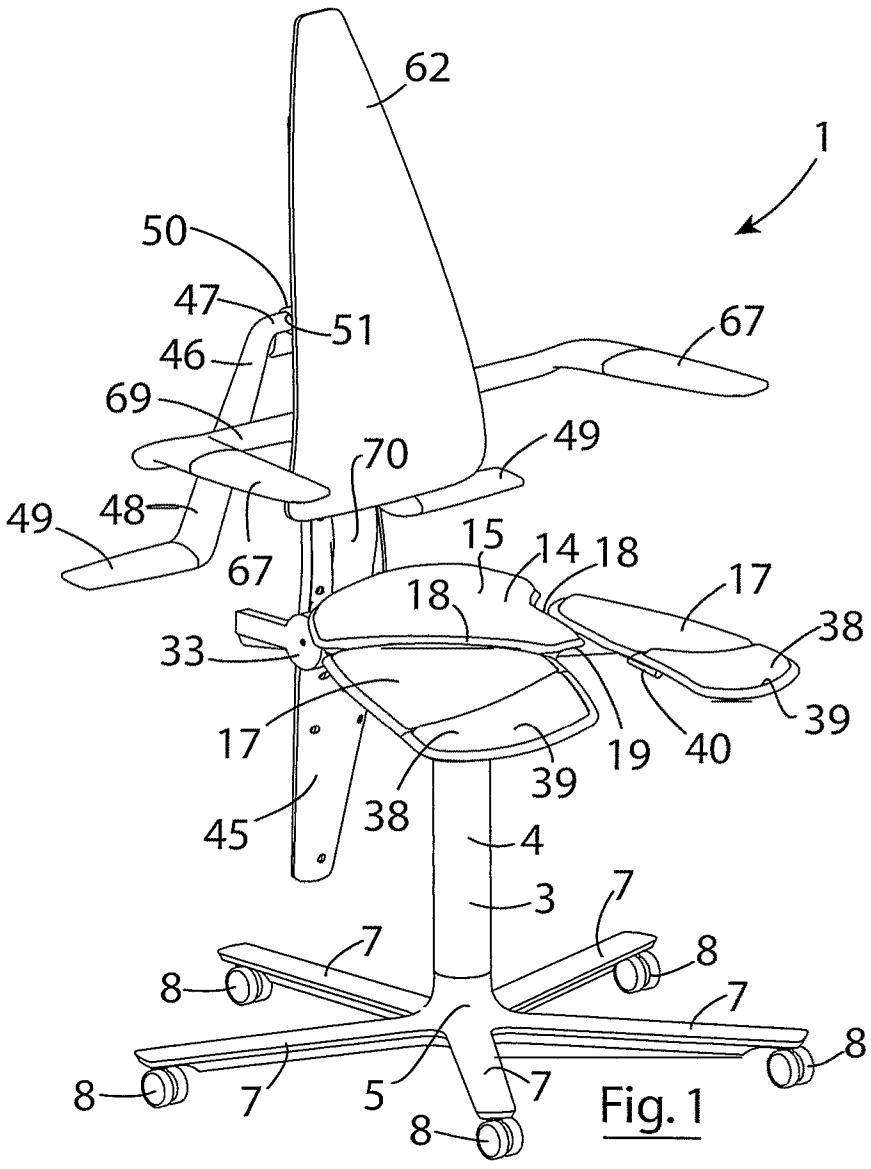
FIG. 1 is a perspective view of a chair according to the invention.
Figure 4:
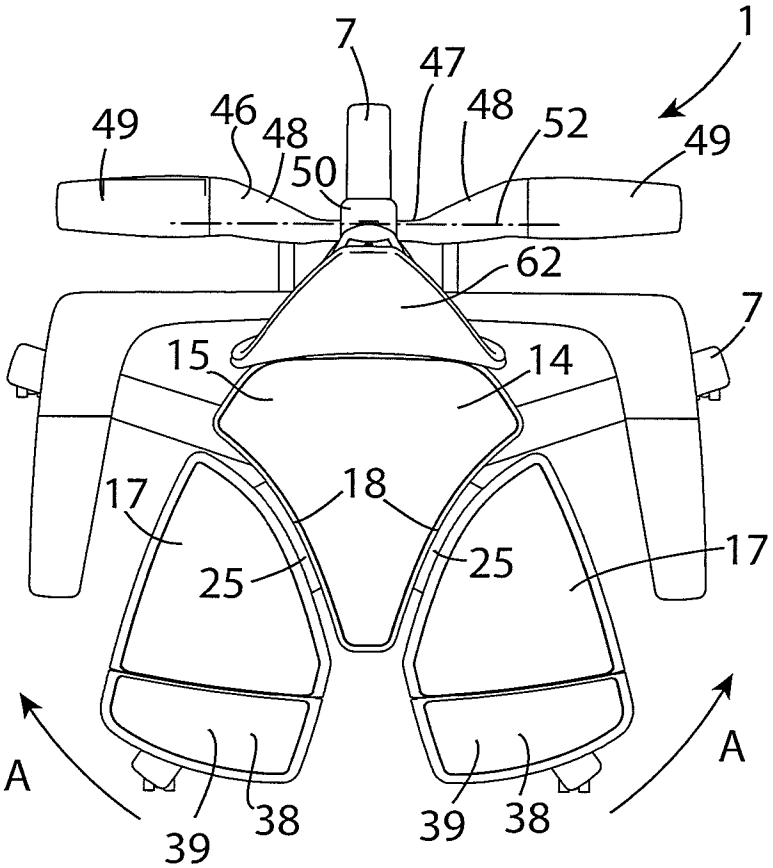
FIG. 4 is a top plan view of the chair of FIG. 1.
Figure 6:
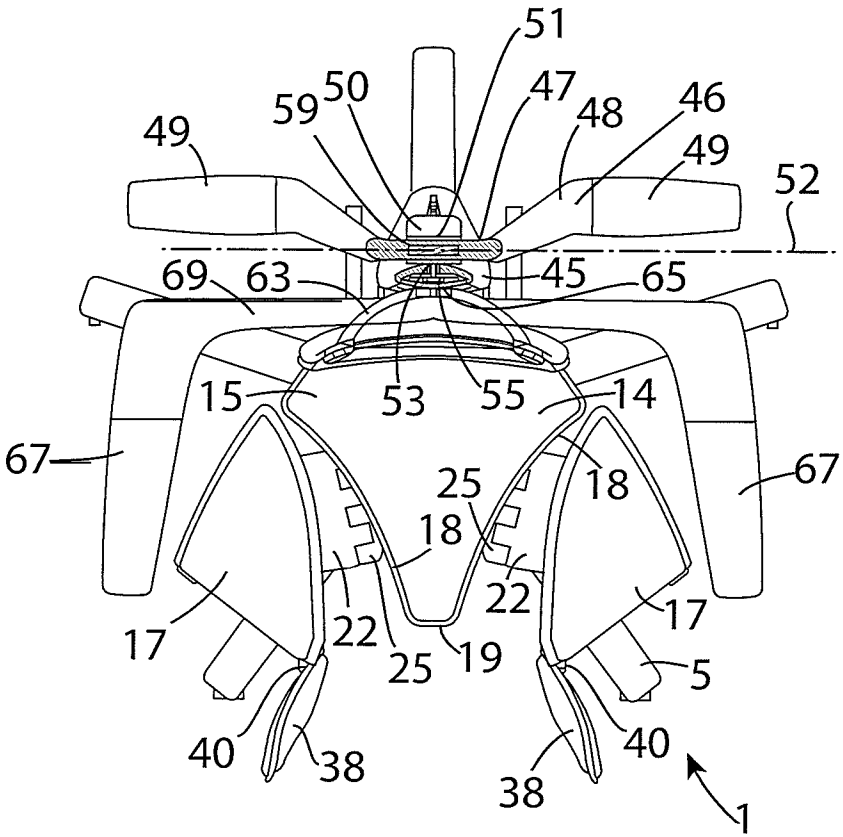
Figure 5:
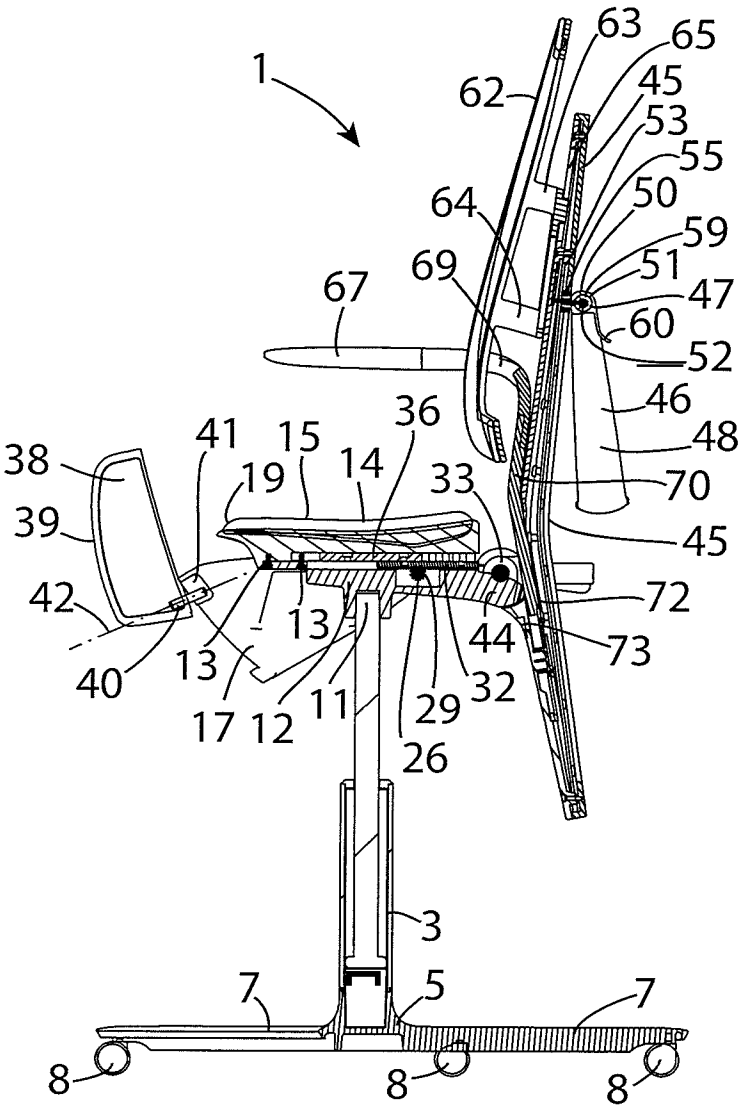
Figure 8:
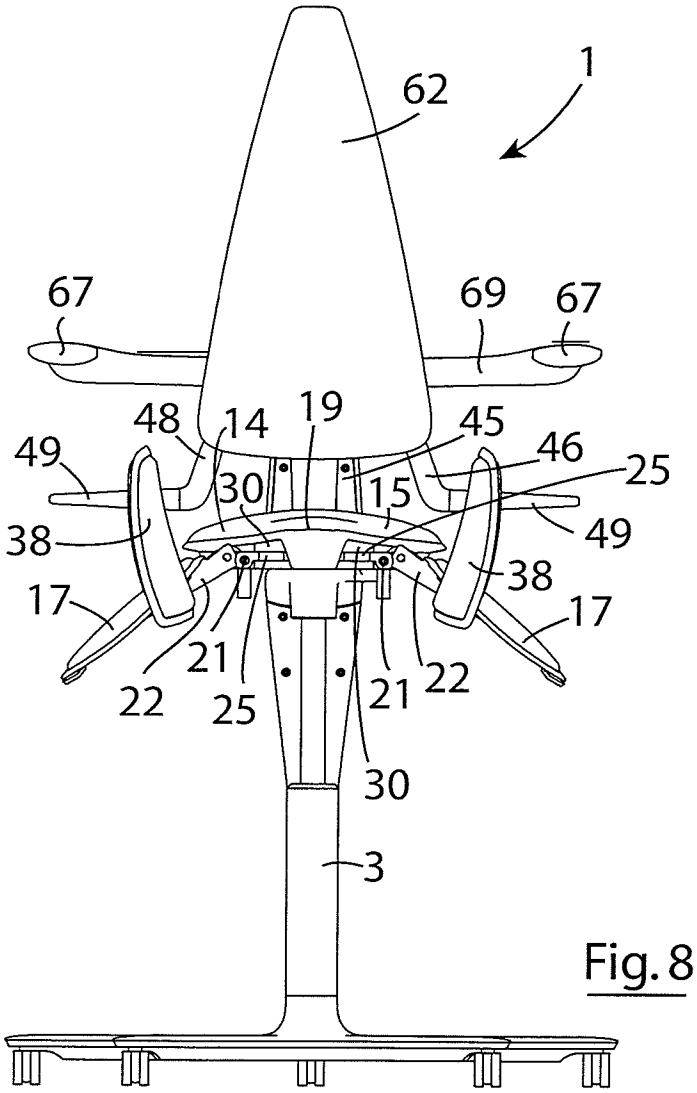
Figure 7:
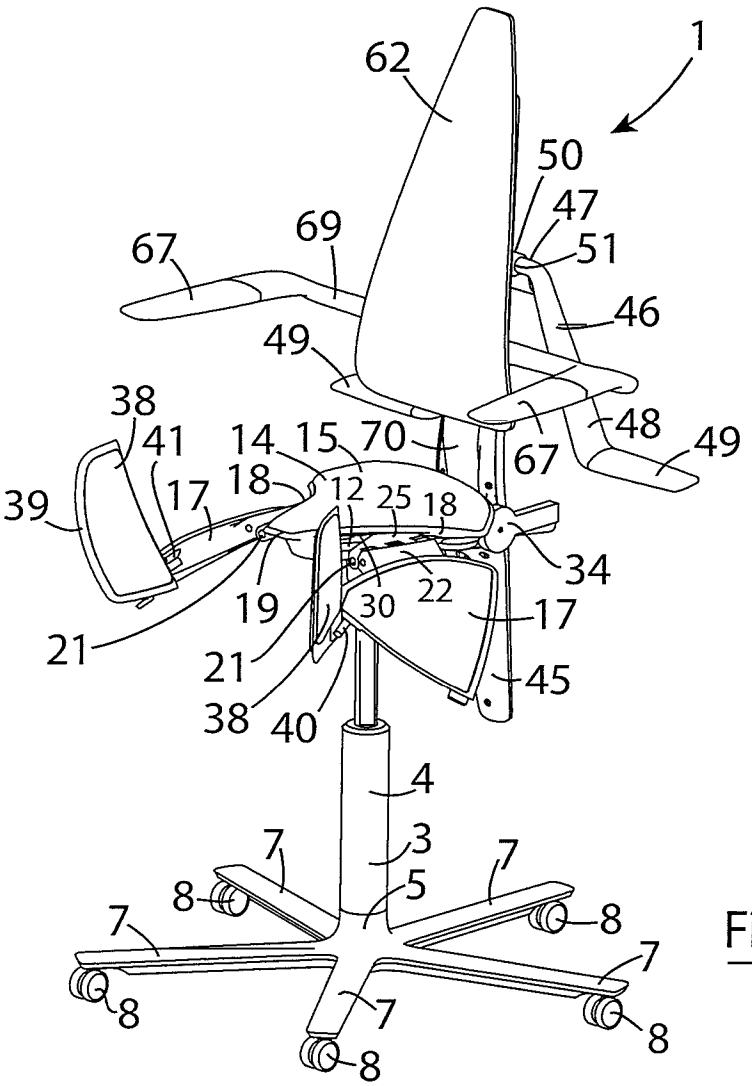
Figure 10:
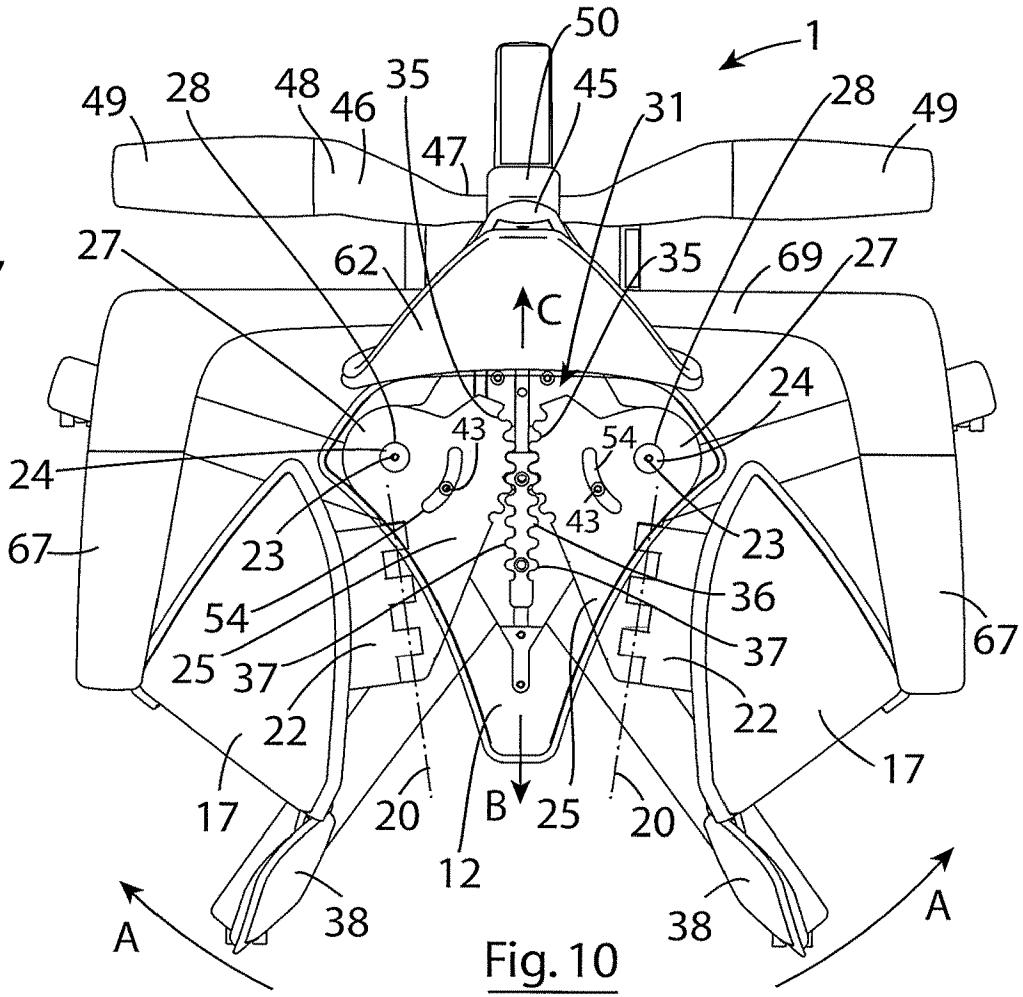
Figure 9:
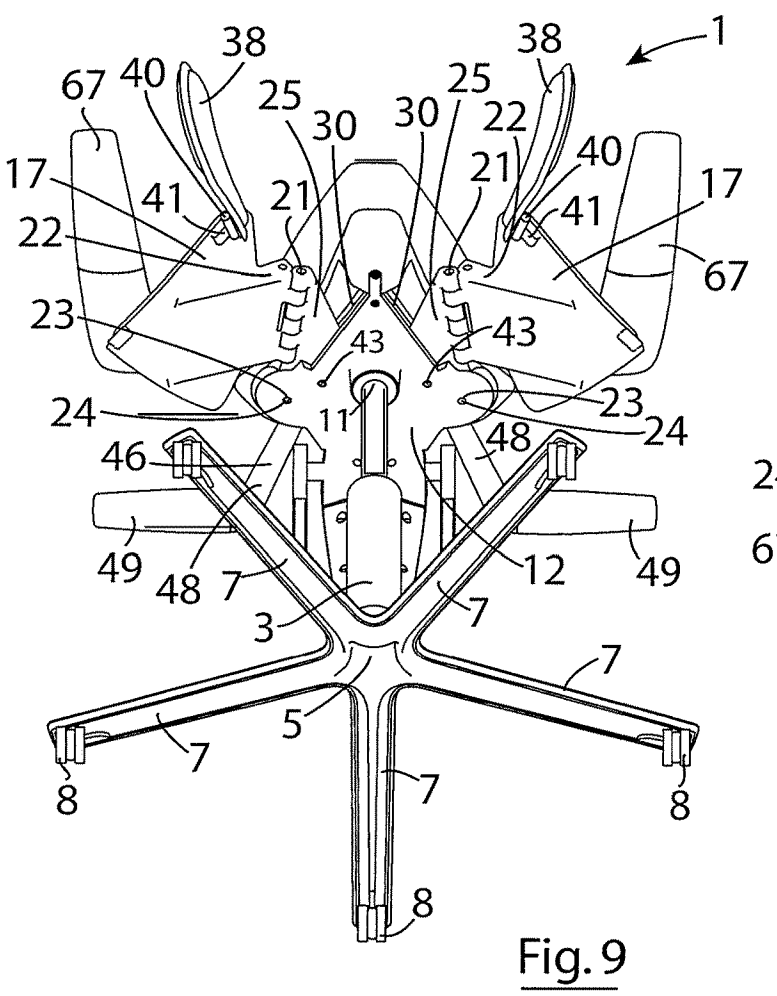
Figure 12:
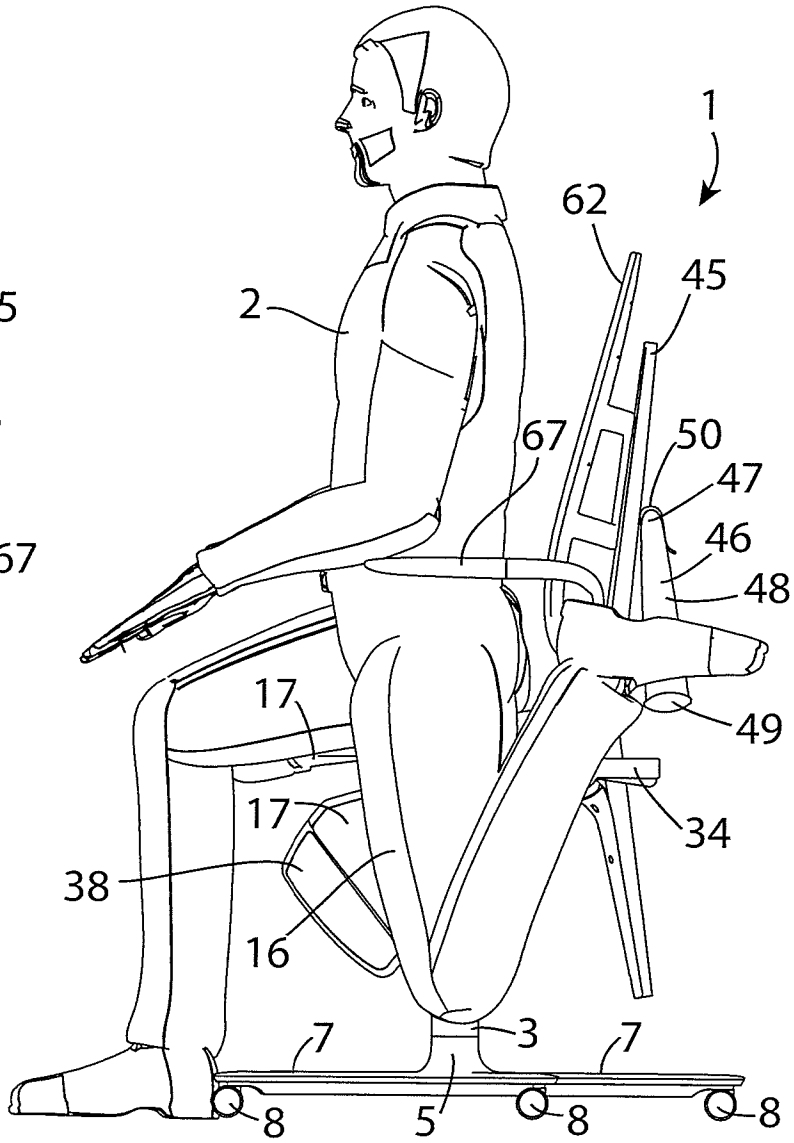
Figure 11:
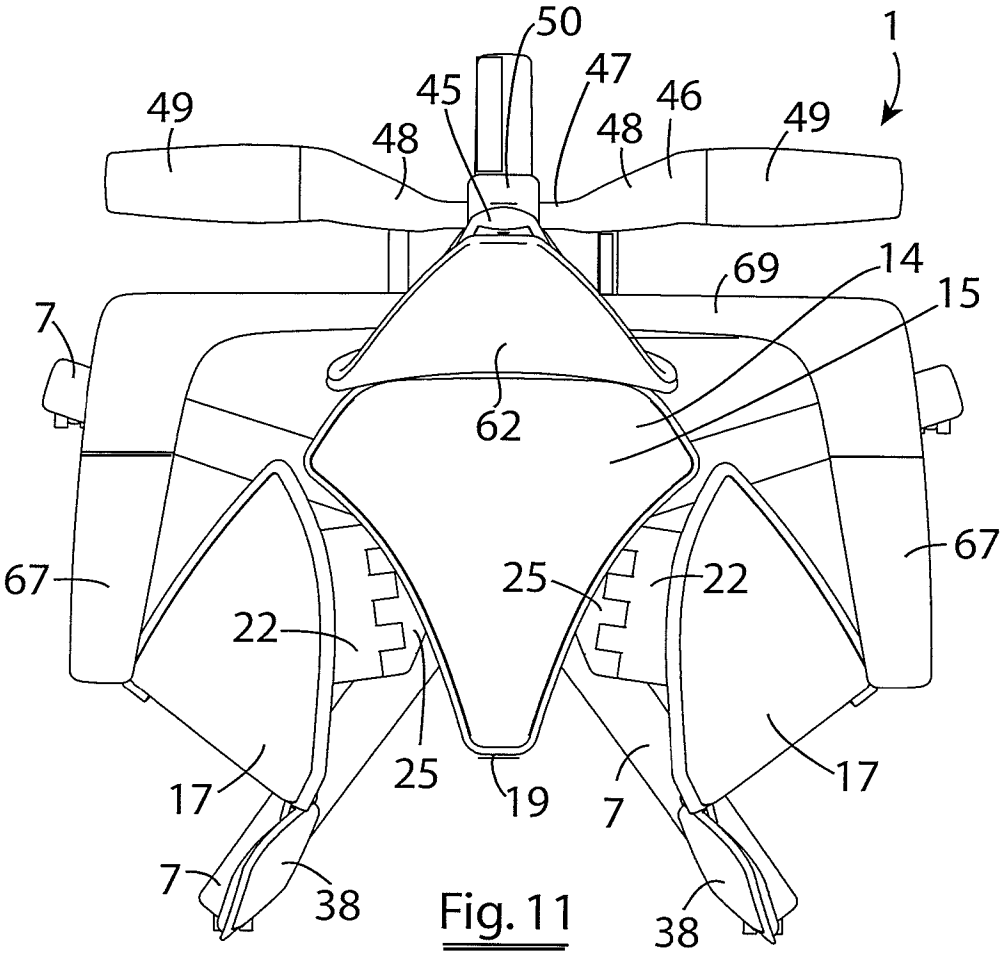
Figure 14:
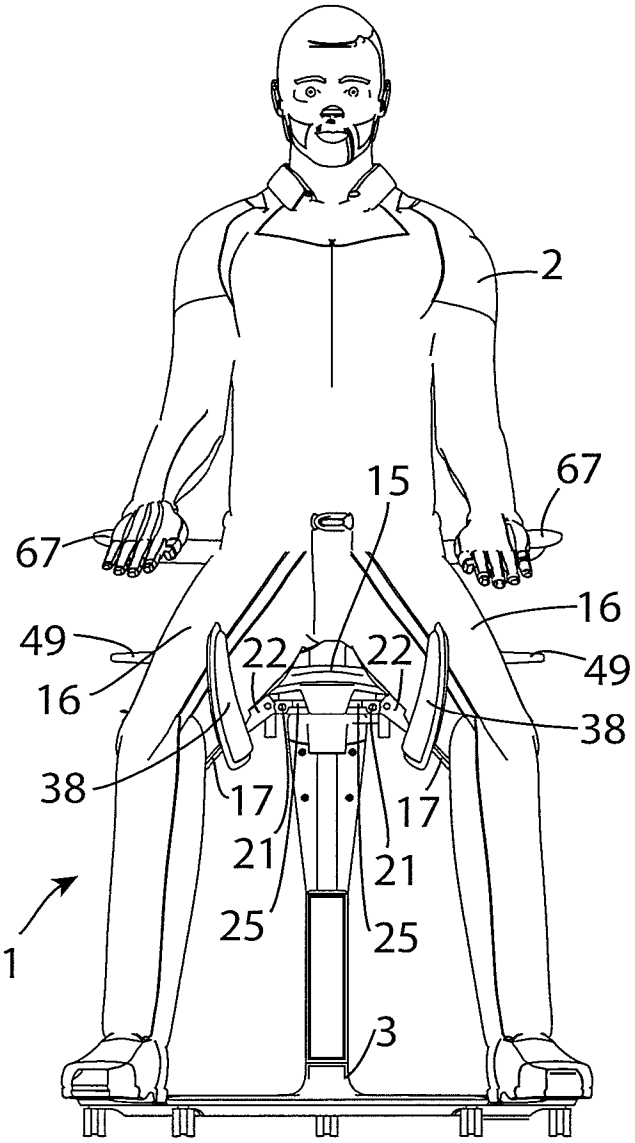
Figure 13:
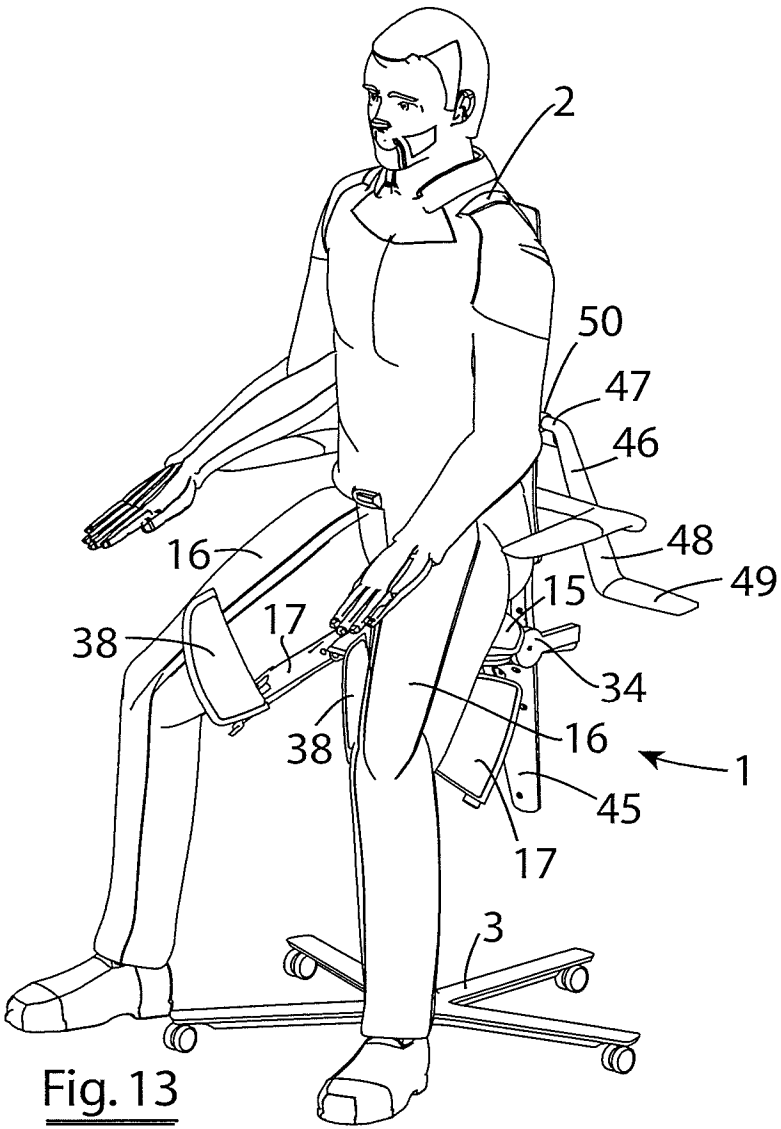
Figure 16:
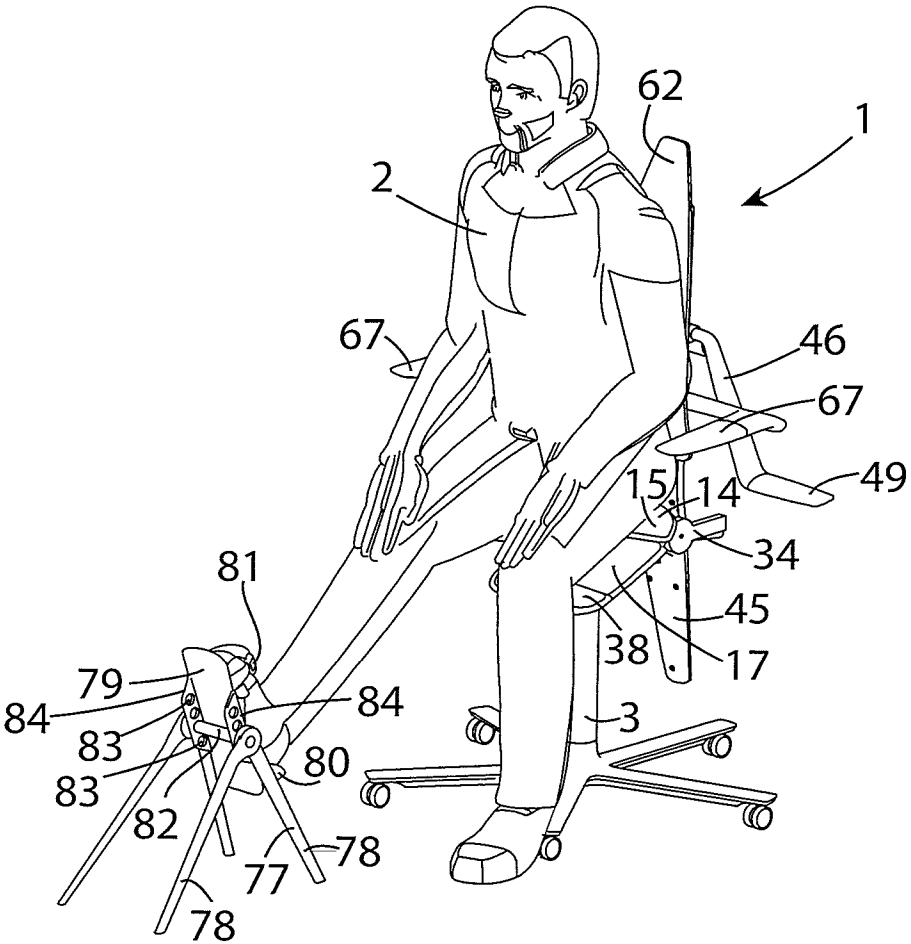
Figure 15:
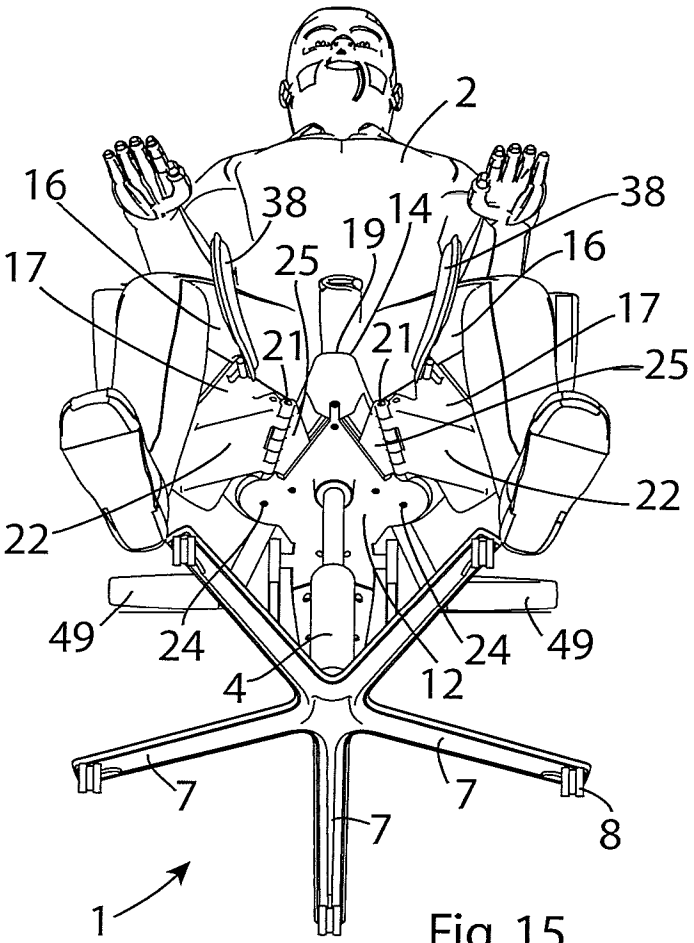
Figure 18:
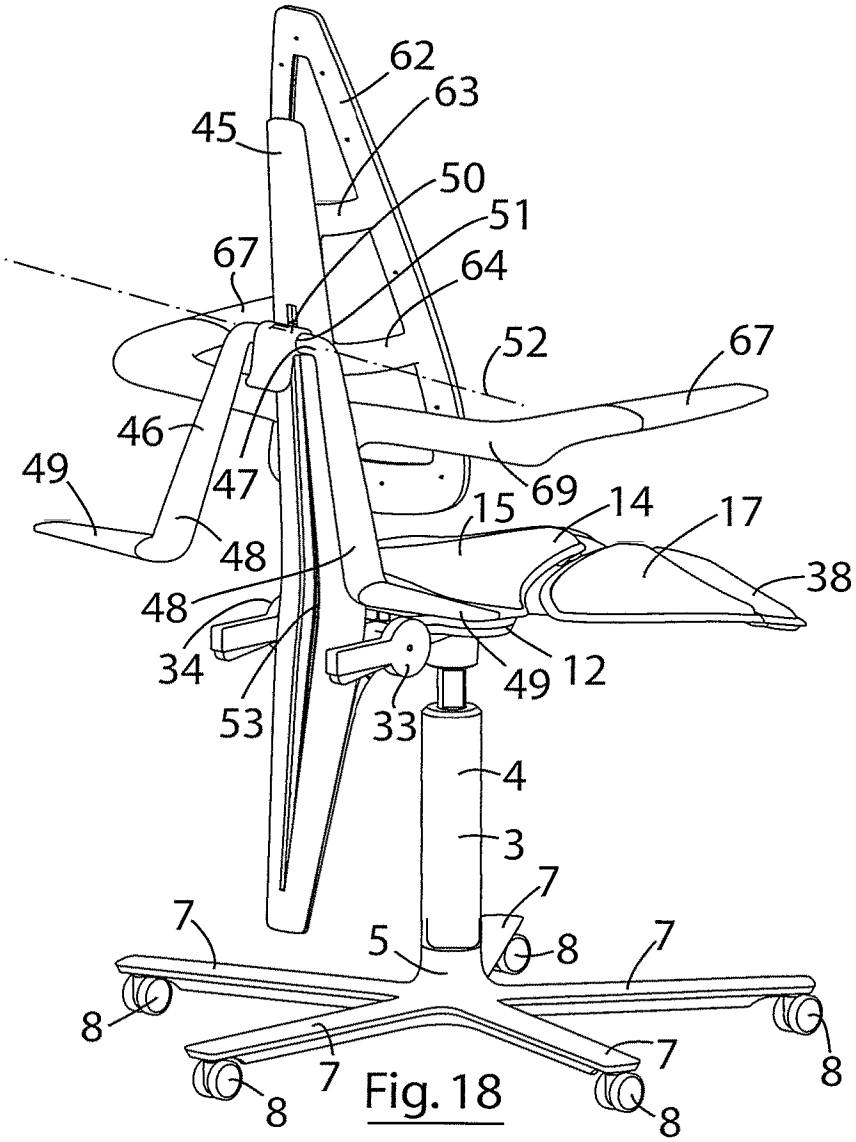
Figure 17:
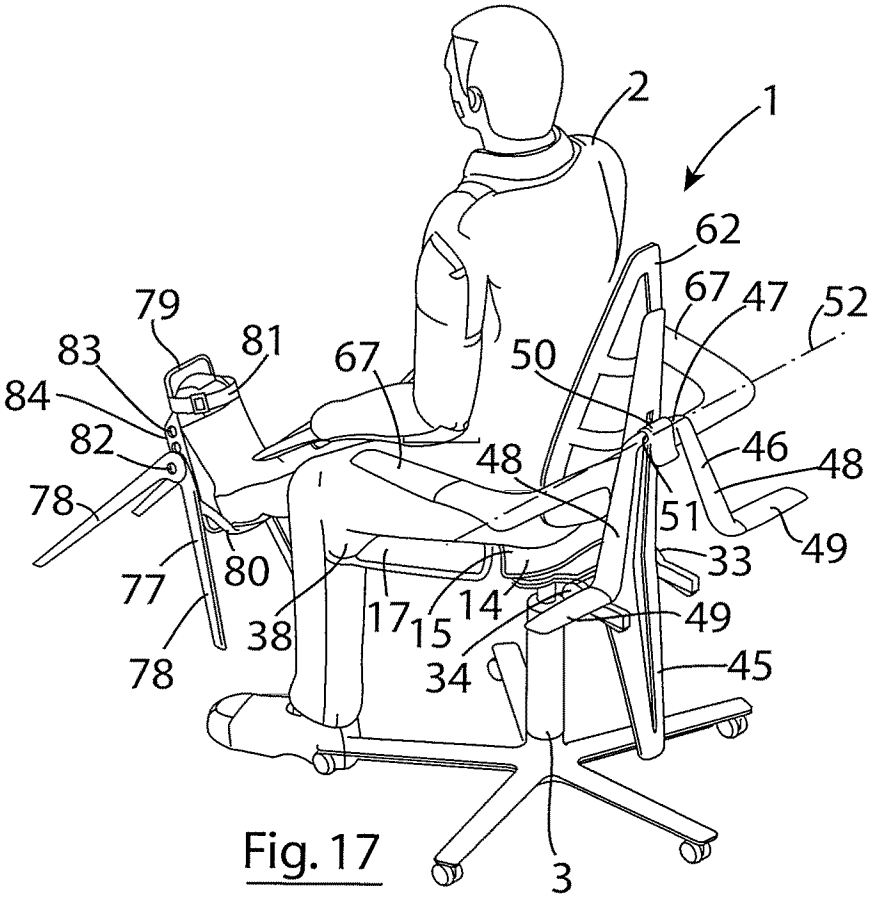
Figures 21, 23, 23A, 24, 24A:
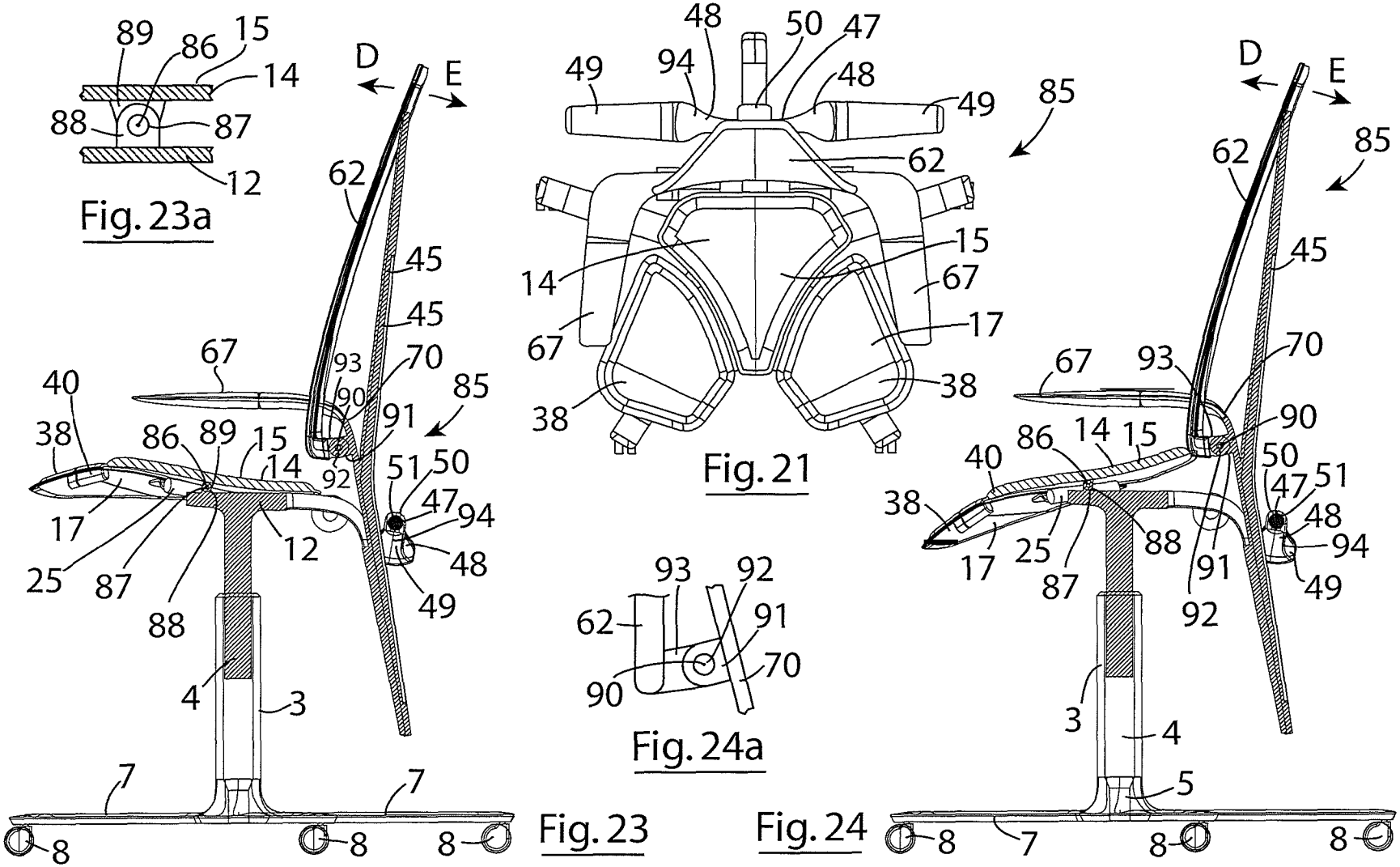

FIG. 5 is a cross-sectional side elevational view of the chair of FIG. 1 with a portion of the chair in a different state to that of FIG. 1, FIG. 6 is a partly cross-sectional top plan view of the chair of FIG. 1 with portions of the chair in a different state to that of FIG. 1, FIG. 7 is a perspective view of the chair of FIG. 1 with portions of the chair in the state of FIG. 6, FIG. 8 is a front elevational view of the chair of FIG. 1 with portions of the chair in the same state as that of FIG. 6, FIG. 9 is an underneath perspective view of the chair of FIG. 1 with portions of the chair in the state of FIG. 6, FIG. 10 is a partly cut-away top plan view of the chair of FIG. 1 with portions of the chair in the state of FIG. 6, FIG. 11 is another top plan view of the chair of FIG. 1 with portions of the chair in a different state to that of FIG. 1, FIG. 12 is a side elevational view of the chair of FIG. 1 in use, FIG. 13 is a perspective view of the chair of FIG. 1 also in use, FIG. 14 is a front elevational view of the chair of FIG. 1 also in use, FIG. 15 is an underneath perspective view of the chair of FIG. 1 also in use, FIG. 16 is a perspective view of the chair of FIG. 1 also in use, FIG. 17 is a perspective view of the chair of FIG. 1 also in use, FIG. 18 is another perspective view of the chair of FIG. 1, FIG. 19 is a perspective view of a chair according to another embodiment of the invention, FIG. 20 is a side elevational view of the chair of FIG. 19, FIG. 21 is a top plan view of the chair of FIG. 19, FIG. 22 is a top plan view of the chair of FIG. 19 with a portion of the chair in a different state to that of FIG. 19, FIG. 23 is a cross-sectional side elevational view of the chair of FIG. 19, FIG. 23*a* is an enlarged cross-sectional side view of a detail of the chair of FIG. 19, FIG. 24 is a cross-sectional side elevational view of the chair of FIG. 19 illustrating a portion of the chair in a different state to that of FIG. 19, FIG. 24*a* is an enlarged side elevational view of another detail of the chair of FIG. 19, FIG. 25 is a cross-sectional side elevational view of a chair according to a further embodiment of the invention, and FIG. 25*a* is an enlarged side elevational view of a detail of the chair of FIG. 25.

Referring to the drawings, and initially to FIGS. 1 to 18, there is illustrated a chair according to the invention indicated generally by the reference numeral 1. The chair 1 is particularly suitable for facilitating carrying out leg stretching exercises by a subject 2 seated on the chair, and in particular leg stretching exercises, for exercising various leg muscles and lower body muscles of the subject as will be described below. A particular advantage of the chair 1 is that it may be used as an office chair, or indeed for any other purpose for supporting a subject in a seated position, while at the same time the seated subject may carry out the stretching exercises.

The chair 1 comprises a ground engaging support 3, which in this embodiment of the invention comprises a central pod 4 extending upwardly from a base 5 having five arms 7 extending radially from the central pod 4 and arranged equi-spaced apart circumferentially around the central pod 4. Each arm 7 carries a corresponding ground engaging castor 8. The central pod 4 defines a main substantially vertical central axis 10 and terminates at its upper end 11 in a main support platform 12 which carries a seat 14. The seat 14 comprises a central seat element 15 and a pair of thigh support elements 17 extending from the central seat element 15 for supporting the corresponding thighs 16 of a seated subject 2. The central seat element 15 is secured to the main support platform 12 by screws 13, and is of saddle shape construction and is configured to support the buttocks of a subject 2 seated thereon. A pair of opposite side edges 18 of the central seat element 15 converge forwardly to a forward portion 19. The thigh support elements 17 extend along the side edges 18 of the central seat support element 15 and extend substantially forwardly therefrom in a rest position illustrated in FIG. 4 forming with the central seat element 15 the seat 14, as will be described in more detail below. The central pod 4 is of telescoping construction for facilitating adjustment of the level of the seat 14 relative to the ground, and also for facilitating pivoting of the seat 14 about the main central axis 10. Such central pods as the central pod 4 will be well known to those skilled in the art, and further description should not be required. Additionally, the central pod 4 is configured to allow the level of the seat 14 to be adjusted to an upper level for supporting the buttocks of a subject when the subject is essentially in a standing state.

Figure 2:
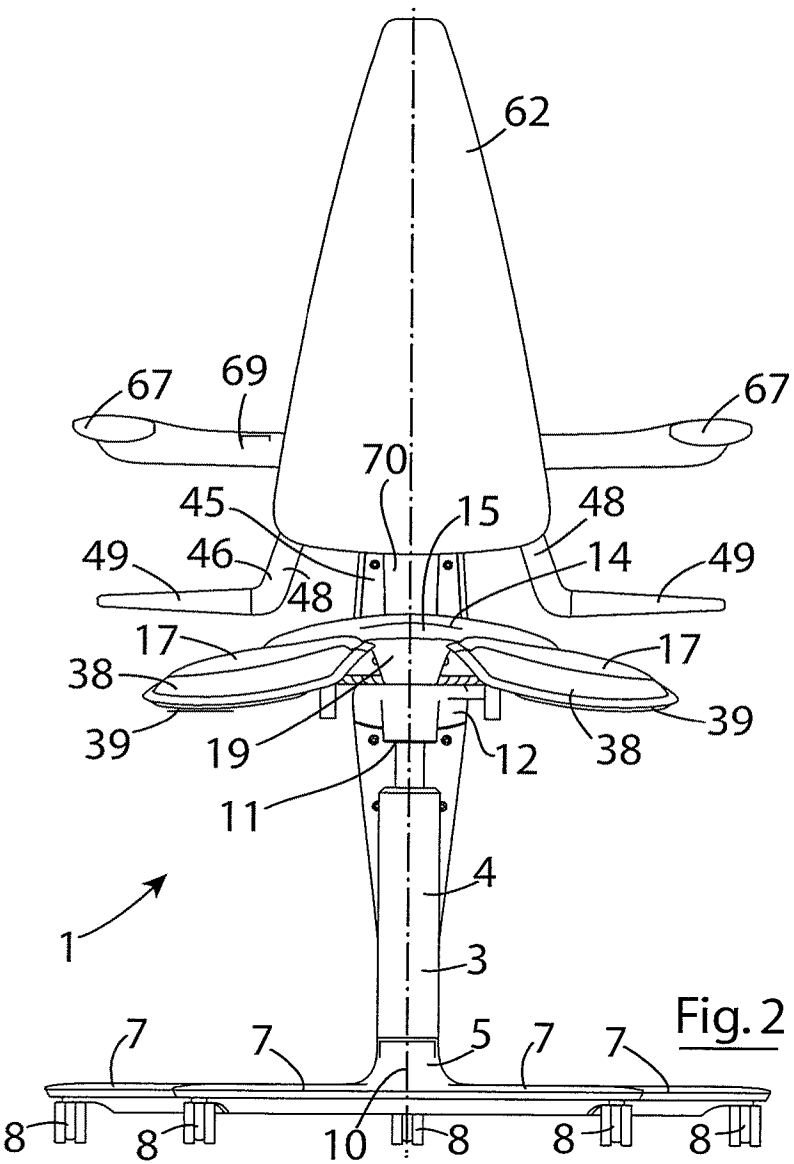
FIG. 2 is a front elevational view of the chair of FIG. 1.
Figure 3:
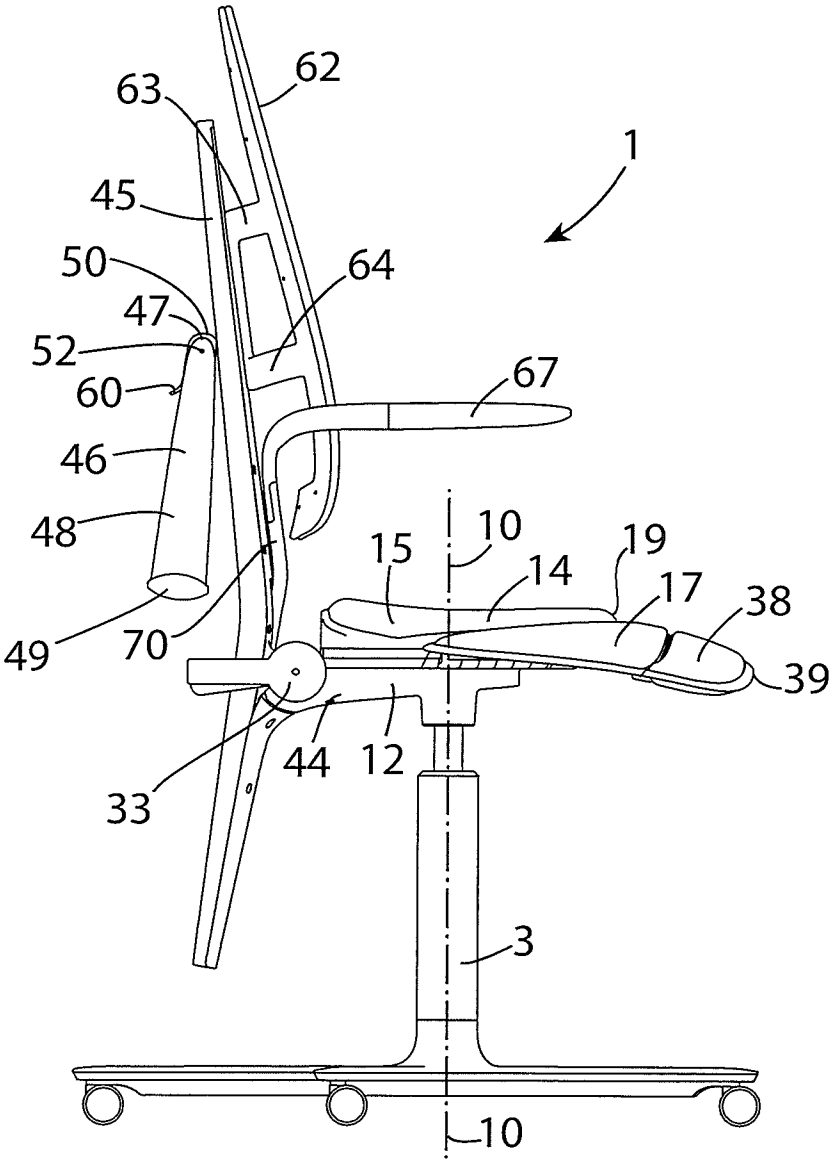
FIG. 3 is a side elevational view of the chair of FIG. 1.

Each thigh support element 17 is pivotal relative to the central seat element 15 about a substantially horizontal first pivot axis 20 defined by a first pivot shaft 21 from a first state illustrated in FIGS. 2 and 3 defining with the central seat element 15 a substantially common plane, generally downwardly through a downward arc to a second state illustrated in FIG. 12 with the thigh support elements extending generally downwardly, through any number of downwardly inclined states for facilitating stretching the quadriceps and hip flexor muscles, as will be described below with reference to FIG. 12. Each thigh support element 17 is also pivotal relative to the central seat element 15 about a substantially vertically extending second pivot axis 23 defined by a second pivot shaft 24 from the rest position generally rearwardly in the direction of the arrows A, see FIG. 4, for stretching the adductor muscles as will be described below with reference to FIGS. 13 to 15.

Turning initially to the pivoting of the thigh support element 17 about the second pivot axis 23, each second pivot shaft 24 extends between the main support platform 12 and the central seat element 15, and pivotally engages a corresponding pivot arm 25 which carries the corresponding thigh support element 17, see FIGS. 9 and 10. The pivot shafts 25 are located between the main support platform 12 and the central seat element 15, and extend through side slots 30 between the main support platform 12 and the central seat element 15 along the side edges 18 of the central seat element 15. Each pivot arm 25 terminates in a disc portion 27 having a bore 28 extending therethrough which pivotally engages the corresponding second pivot shaft 24. The pivot shafts 24 define the respective second pivot axes 23 about which the thigh engaging elements 17 are simultaneously pivotal away from each other in generally rearwardly directions, namely, in the directions of the arrows A from the rest position for supporting the corresponding thighs 16 of a seated subject 2 during stretching of the adductor muscles as illustrated in FIGS. 13 to 15.

The pivot arms 25 of the respective thigh support elements 17 each carry the corresponding first pivot shaft 21 which defines the corresponding first pivot axis 20 about which the corresponding thigh support element 17 is pivotal between the first and second states, see FIGS. 9 and 10. Pivot mounting brackets 22 extending from the respective thigh support elements 17 pivotally engage the corresponding first pivot shafts 21 for pivoting of the thigh support elements about the corresponding first pivot axes 20 from the first state through the downward arc to the second downwardly extending state.

A first urging means, namely, a ratchet mechanism (not shown) acting between the first pivot shaft 21 and the pivot mounting bracket 22 of each thigh support element 17 incrementally pivots the corresponding thigh support element 17 between the first and second states into any selected inclined state between the first and second states. The ratchet mechanism in this case also acts as a first retaining means for retaining the corresponding thigh support element in a desired state between and including the first and second states. Alternatively, the first urging means may comprise a resilient urging means such as a torsional spring provided on the first pivot shaft 21 and acting between the corresponding pivot arm 25 and the pivot mounting bracket 22 of the corresponding thigh support element 17 for urging the corresponding thigh support element 17 in a generally upwardly direction into the first state. In this case a first retaining means would comprise a first latching system provided in each pivot mounting bracket 22 for releasably securing the corresponding thigh support element 17 in the selected state between and including the first and second states.

A second urging means is provided for simultaneously pivoting the thigh support elements 17 about the second pivot axes 23 from the rest state away from each other in the generally rearwardly direction. Any suitable second urging means may be provided, however, in this embodiment of the invention the second urging means comprises a rack and pinion drive mechanism 31. The disc portion 27 of each pivot arm 25 defines a portion of a pinion 35 with the central axis of each pinion 35 coinciding with the corresponding second pivot axis 23 defined by the corresponding second pivot shaft 24. A double-sided gear rack 36 having main rack gears 37 on respective opposite sides thereof engage the pinions 35, so that as the gear rack 36 is urged in the direction of the arrow B in a generally forwardly direction from the rear of the central seat element 15 towards the forward portion 19, the pinions 35 pivot the corresponding thigh support elements 17 in the generally rearwardly direction in the direction of the arrows A from the rest state, see FIG. 10. Movement of the rack 36 in the reverse direction, namely, in the direction of the arrow C operates the pinions 35 to urge the thigh engaging elements 17 into the rest state.

Limit means for limiting the pivotal movement of the pinions 35 about the second pivot axes 23, and in turn for limiting the rearward pivoting of the thigh support elements 17, comprise a pair of limit stop members 43 extending between the main support platform 12 and the central seat element 15. The limit stop members 43 extend through corresponding arcuate limit slots 54 in the pinions 35 for limiting the angular pivoting of the pinions 35, and in turn the angular pivotal movement of the thigh support elements 17 between the rest state and the maximum rearward state. In this embodiment of the invention the limit stop members 43 and the limit slots 54 cooperate to limit the rearward pivoting of the thigh support elements 17 to an angle of approximately 70° from the rest state.

A secondary gear rack 32 secured to the underside of the gear rack 36 is engageable with a secondary pinion 29 fast on a shaft 26, which is rotatably mounted in the main support platform 12, so that rotation of the secondary pinion 29 urges the gear rack 36 in the directions of the arrows B and C. The secondary pinion 29 may be manually operated, or may be operated by a servomotor, a stepper motor or any other suitable drive means. In this embodiment of the invention the secondary pinion 29 is driven in a direction for urging the rack 36 in the direction of the arrow B, for in turn urging the thigh support elements 17 in the generally rearwardly direction by a manually operated ratchet mechanism 33. A belt drive transmission (not shown) transmits drive from the ratchet mechanism 33 to the shaft 26 for in turn rotating the secondary pinion 29 for urging the gear rack 36 in the direction of the arrow B. A quick release mechanism 34 releases the ratchet mechanism 33 for returning the rack 36 in the direction of the arrow C for returning the thigh support elements 17 to the rest state. Additionally, in this embodiment of the invention the ratchet mechanism 33 and the rack and pinion drive 31 also act as a releasable second retaining means for retaining the thigh support elements 17 in desired angular positions about the second pivot axes 23.

Each thigh support element 17 comprises a corresponding inner thigh engaging means, namely, a thigh engaging element 38 which is formed by a distal portion 39 of the corresponding thigh support element 17. Each thigh engaging element 38 is pivotally coupled to the corresponding thigh support element 17 and is pivotal between an inactive state illustrated in FIGS. 3 and 4 with the thigh engaging element 38 defining with the corresponding thigh support element 17 a substantially common plane, and an active state illustrated in FIGS. 6, 7 and 8 for engaging an inner portion of the corresponding thigh of a seated subject for retaining the thigh on the thigh support element 17 of the seated subject during stretching of the adductor muscles, see FIGS. 13 to 15. A pivot pin 40 secured fast to each thigh engaging element 38 pivotally engages a corresponding pivot mounting bracket 41 mounted on the corresponding thigh support element 17. Each pivot pin 40 defines a substantially horizontal third pivot axis 42 when the corresponding thigh support element 17 is in the first state, about which the corresponding thigh engaging element 38 pivots between the inactive state and the active state.

A rearwardly extending member 44 extends rearwardly from the main support platform 12, and carries an upwardly extending rear support member 45. The rear support member 45 extends in a generally upwardly direction behind the seat 14 from a level below the seat 14 to a level about the seat 14. A carrier element 46 is adjustably connected to the rear support member 45 as will be described below. The carrier element 46 is of inverted U-shaped construction comprising a central cross-member 47 and a pair of spaced apart downwardly extending side members 48 extending downwardly from the respective opposite ends of the cross-member 47. The side members 48 at their lower ends terminate in a pair of foot support means, namely, elongated foot support members 49 which extend transversely and sidewardly outwardly from the side members 48 of the carrier element 46 on respective opposite sides of the chair 1. The foot support members 49 are configured for engaging and supporting the corresponding foot of the seated subject adjacent the instep thereof to facilitate stretching the quadriceps and hip flexor muscles of a subject as will be described below with reference to FIG. 12.

An adjustable connecting means, in this embodiment of the invention a pivot connector 50 pivotally and adjustably connects the carrier element 46 to the rear support member 45, with the carrier element 46 pivotal about a transversely extending horizontal transverse pivot axis 52 defined by a pivot bore 51 extending through the pivot connector 50, so that the foot support members 49 are pivotal about the transverse pivot axis 52 in a generally forwardly rearwardly direction. The pivot connector 50 is also slideably engageable along an elongated guide track 53 extending longitudinally in a generally upwardly and downwardly direction within the rear support member 45 for facilitating adjustment of the level of the foot support members 49 relative to the level of the seat 14.

A first securing means in this embodiment of the invention a first friction clamp 55 located in the pivot connector 50 is engageable with the guide track 53 for clamping the pivot connector 50 onto the guide track 53 for releasably securing the pivot connector 50 to the guide track 53 and in turn for setting the level of the foot support members 49 at a desired level relative to the level of the seat 14. A second securing means, in this embodiment of the invention a second friction clamp 59 located in the pivot connector 50 is releasably engageable with the central cross-member 47 of the carrier element 46 for releasably securing the carrier element 46 to the pivot connector 50 for securing the central cross-member 47 in the pivot connector 50 with the carrier element, and in turn the foot support members 49 at a desired angular position about the transverse axis 52. A lever 60 extending from the pivot connector 50 operates the first and second friction clamps 55 and 59 for clamping and unclamping the pivot connector 50 onto the guide track 53 and onto the central cross-member 47 of the carrier element 46.

A backrest 62 is located above and behind the seat 14 for supporting the back of a subject seated thereon. The backrest 62 is carried on the rear support member 45 by upper and lower mounting members 63 and 64, respectively. The mounting members 63 and 64 are slideable in a forward guide slot 65 extending longitudinally in the rear support member 45 for facilitating altering of the height of the backrest 62 relative to the seat 14. A third securing means for securing the backrest 62 to the rear support member 45 at the desired height relative to the seat 14 comprises a third friction clamp (not shown) which clamps the upper and lower mounting members 63 and 64 in the forward guide slot 65.

A pair of spaced apart armrests 67 are located on respective opposite sides of the chair 1 and are carried on a carrier bracket 69 which extends transversely across the rear of the chair 1. A downwardly extending mounting member 70 extending downwardly and rearwardly from the carrier bracket 69 is engageable in a receiving guide bore 72 of rectangular transverse cross section extending into the rear support member 45, adjacent the rearwardly extending member 44 extending from the main support platform, for adjustably receiving the mounting member 70 therein for facilitating altering the level of the armrests 67 relative to the level of the seat 14. A fourth releasable securing means, in this embodiment of the invention a friction grip element 73 located in the rear support member 45 releasably secures the mounting member 70 in the rear support member 45 with the armrests 67 at a desired level relative to the level of the seat 14.

Referring now to FIGS. 16 and 17, there is illustrated a ground engaging foot support 77 for supporting a foot of a subject 2 seated on the chair 1 during a hamstring and calf stretch. The ground engaging foot support 77 comprises a ground engaging framework 78 which supports a foot support plate 79. A heel engaging element 80 extends from the foot support plate 79 for engaging the heel of a subject 2 seated on the chair 1. An adjustable strap 81 secures the toe portion of the foot of the subject 2 to the foot support plate 79. The foot support plate 79 is adjustably secured to the ground engaging framework 78 by a shaft 82, which is selectively engageable with bores 83 extending through side flanges 84, which extend along the foot support plate 79, so that the level of the foot support plate 79 is adjustable above the ground, and the angle of the foot support plate 79 is also adjustable by pivoting the shaft 82 in the selected bores 83. By adjusting the angle of the foot support plate 79, the degree of stretch induced in the calf and hamstring muscles is adjustable.

Although only one ground engaging foot support 77 for use with the chair 1 according to the invention is illustrated, it is envisaged that a pair of ground engaging foot supports 77 may be provided for use with the chair 1.

In this embodiment of the invention the position of the pivot connector 50 is adjustable along the guide track 53 in the rear support member 45 over a distance of approximately 600 mm so that the foot support members 49 are adjustable from a maximum lower level at a level below the level of the seat 14 of approximately 400 mm to a maximum upper level at a level of approximately 200 mm above the level of the seat 14. Although in some embodiments of the invention it is envisaged that the position of the pivot connector 50 on the guide track 53 may be adjustable between a maximum lower level of approximately 300 mm below the level of the seat 14 and a maximum upper level of approximately 200 mm above the level of the seat 14. However, needless to say the maximum lower and upper levels between which the foot support members 49 are adjustable relative to the level of the seat may be different to those described.

In use, when it is desired to stretch the quadriceps and the hip flexor muscles corresponding to one of the legs of a seated subject 2, the level of the carrier element 46 is adjusted so that the foot support member 49 corresponding to the leg of which the quadriceps and the hip flexor muscles are to be stretched is at a level relative to the seat 14 which will provide the desired degree of stretching of the quadriceps and the hip flexor muscles. When the foot support member 49 is at the desired level relative to the level of the seat 14, the first friction clamp 55 is operated to clamp the pivot connector 50 onto the guide track 53 in the rear support member 45. If it is desired to pivot the foot support member 49 about the transverse pivot axis 52 the second friction clamp 59 is left unclamped, otherwise the second friction clamp 59 is operated to clamp the pivot connector 50 onto the central cross-member 47 with the foot support members 49 at the desired angular position relative to the transverse pivot axis 52.

With the corresponding thigh support member 17 in the rest state, the thigh support element 17 is pivoted downwardly from the first state about the corresponding first pivot axis 20, either to the second downwardly extending state, or to a downwardly inclined state intermediate the first and second states to accommodate the thigh of the subject extending generally downwardly or downwardly inclined at a comfortable angle when the corresponding foot of the seated subject 2 is supported on the corresponding foot support member 49 with the instep of the foot of the subject engaged on the foot support member 49.

The subject 2, seated on the seat 14 then places the instep of the foot of the leg, of which the corresponding quadriceps and hip flexor muscles are to be stretched, on the corresponding foot support member 49. With the thigh of the leg engaging the correspondingly downwardly extending or downwardly inclined thigh support element 17, and with the corresponding foot supported on the foot support member 49 by the instep thereof, the quadriceps and the hip flexor muscles of the corresponding leg of the seated subject are stretched to the desired degree. The seated subject remains in position with the foot supported on the corresponding foot support member 49 until the quadriceps and the hip flexor muscles of the seated subject have been subjected to the desired degree of stretch for the desired time period.

If the subject wishes to increase or decrease the degree of stretching to which the quadriceps and the hip flexor muscles are being subjected, the level of the corresponding foot support member 49 is adjusted upwardly or downwardly, as the case may be. Raising the level of the foot support member 49 relative to the level of the seat 14, increases the degree of stretch to which the quadriceps and the hip flexor muscles are subjected, and reducing the level of the foot support member 49 relative to the level of the seat 14 reduces the degree of stretch to which the quadriceps and the hip flexor muscles are subjected.

If the carrier element 46 had been clamped to the pivotal connector 50 by the second friction clamp 59, by releasing the second friction clamp 59, the carrier element 46 becomes pivotal about the transverse pivot axis 52, and thus, during stretching of the quadriceps and the hip flexor muscles, the subject may rock the leg of which the quadriceps and the hip flexor muscles are being stretched backwards and forwardly by rocking the foot support member 49 backwardly and forwardly about the transverse horizontal pivot axis 52 of the carrier element 46.

When it is desired to stretch one or both of the adductor muscles, with the thigh support elements 17 in the first state supporting the respective thighs of the seated subject, and with the thigh engaging elements 38 in the active state engaging inner portions of the respective thighs, the thigh support elements 17 are pivoted in the generally rearwardly direction, namely, in the direction of the arrow A away from each other from the rest state about the corresponding second pivot axes 23 by the rack and pinion drive 31 and the ratchet 33, until the adductor muscles are stretched to the desired degree. The ratchet 33 and the rack and pinion drive 31 retain the thigh support elements 17 secured in this position for retaining the adductor muscles stretched to the desired degree, for the appropriate time period.

When it is desired to stretch the hamstring and calf muscles of one of the legs of the subject, the ground engaging foot support 77 is placed on the ground in front of the chair 1, and the level of the foot support plate 79 above the ground and the angle of the foot support plate 79 are adjusted to the desired height and angle. With the thigh support element 17 for supporting the corresponding thigh of the seated subject in the rest state, the thigh support element 17 is adjusted about the first pivot axis 20 to the desired downwardly inclined angle. The subject then places the relevant foot on the foot support plate 79 which is secured thereto by the strap 81.

In all cases, the subject maintains the stretched states of the respective muscles for an appropriate time, which typically, is sent in a predefined stretching regime.

Referring now to FIGS. 19 to 24, there is illustrated a chair according to another embodiment of the invention indicated generally by the reference numeral 85. The chair 85 is particularly suitable for carrying out leg stretching exercises by a subject seated on the chair for stretching various leg muscles as well as muscles in the lower part of the body of the subject. The chair 85 is substantially similar to the chair 1 and similar components are identified by the same reference numerals. The chair 85 also provides substantially similar advantages as the advantages achieved by the chair 1.

The main difference between the chair 85 and the chair 1 lies in the attachment of the seat 14 to the main support platform 12, the attachment of the backrest 62 to the chair 85, and also in the foot support members 49.

Turning initially to the seat 14, in this embodiment of the invention the seat 14 is pivotally coupled to the main support platform 12 about a transversely extending seat pivot axis 86. A transversely extending seat pivot shaft 87 is carried on a pair of transversely spaced apart mounting brackets 88 secured to the main support platform 12, so that the seat pivot shaft 87 extends transversely of the chair 85 and defines the seat pivot axis 86. Only one of the mounting brackets 88 is illustrated in FIGS. 23, 23*a* and 24. A pair of transversely spaced apart pivot mounting brackets 89 extend downwardly from the underside of the central seat element 15 and pivotally engage the seat pivot shaft 87, for pivotally mounting the seat 14 on the main support platform 12 about the transversely extending seat pivot axis 86. Only one of the pivot mounting brackets 89 is illustrated in FIGS. 23, 23*a* and 24. A ratchet mechanism (not shown) or other suitable mechanism is mounted on the main support platform 12 for incrementally pivoting the central seat element 15, and in turn the seat 14 about the seat pivot axis 86 for setting the angle of the seat 14 at a desired angle. In FIG. 23 the seat 14 is illustrated angled at its maximum rearwardly downwardly inclined angle, and in FIG. 24 the seat 14 is illustrated angled at a forwardly downwardly inclined angle, but could be angled further forwardly downwardly.

Turning now to the backrest 62, in this embodiment of the invention the backrest 62 is pivotally coupled about a transversely extending backrest pivot axis 90, and is pivotally forwardly and rearwardly in directions of the arrows D and E about the backrest pivot axis 90 to a desired angle of inclination relative to the seat 14, and if desired the backrest may be pivoted to extend substantially directly upwardly from the seat 14. A pair of transversely spaced apart mounting brackets 91 mounted on the mounting member 70 of the armrests 67 carries a transversely extending backrest pivot shaft 92 which defines the backrest pivot axis 90. A pair of spaced apart pivot mounting brackets 93 extend rearwardly from the lower end of the backrest 62 and pivotally engage the backrest pivot mounting shaft 92 for facilitating pivoting of the backrest 62 relative to the seat 14 about the backrest pivot axis 90. Only one of the mounting brackets 91 and the pivot mounting brackets 93 are illustrated in FIGS. 23, 24 and 24*a*. A ratchet mechanism (not shown) or other suitable mechanism is mounted on the mounting member 70 for incrementally pivoting the backrest 62 about the backrest pivot axis 90 to a desired angle relative to the seat 14. The ratchet mechanism (not shown) also acts as a releasable fixing means for releasably securing the backrest 62 at the desired angle relative to the seat 14.

In this embodiment of the invention the foot support elements 49 are carried on a carrier element 94, which is somewhat similar to the carrier element 46 of the chair 1, with the exception that the side members 48 of the carrier element 94 are considerably shorter. The carrier element 94 comprises a central cross-member 47 similar to the central cross-member 47 of the carrier element 46 of the chair 1, which pivotally engages the bore 51 in the pivot connector 50. The pivot connector 50 is slideably mounted upwardly and downwardly on the rear support member 45 in a similar manner as has already been described with reference to the mounting of the pivot connector 50 on the rear support member 45 of the chair 1.

Otherwise, the chair 85 and its use is similar to the chair 1 and its use.

In both the embodiments of the chair 1 and the chair 85, it is envisaged that the seat 14 may also be mounted on the main support platform 12 to be slideable forwardly and rearwardly relative to the main support platform 12. In the chair 85, the forward and rearward slideable mounting of the seat 14 on the main support platform 12 would be carried out by slideably mounting the mounting brackets 88 which carry the seat pivot shaft 87 so that the mounting brackets 88 would be slideable in suitable guide tracks extending in a generally forwardly rearwardly direction in the main support platform 12.

In the seat 1, in order for the seat 14 to be slideable forwardly and rearwardly, it is envisaged that the main support platform 12 would be provided in two parts, namely, an upper platform part and a lower platform part. The lower platform part would be engageable with the central pod 4, and the upper platform part would carry the seat 14 along with the rack and pinion mechanism. The upper platform part would be slideably mounted on the lower platform part in a generally forwardly rearwardly direction.

Referring now to FIGS. 25 and 25*a* there is illustrated a chair according to another embodiment of the invention indicated generally by the reference numeral 95. The chair 95 is also suitable for carrying out leg stretching exercises by a subject seated on the chair, and is particularly suitable for carrying out leg stretching exercises for stretching various leg muscles and lower body muscles of the subject in a similar manner as the chair 1 is suitable for carrying out such stretching exercises.

The chair 95 is substantially similar to the chair 1, and similar components are identified by the same reference numerals. The only difference between the chair 95 and the chair 1 is in the mounting of the backrest 62. In this embodiment of the invention the backrest 62 is coupled to the rear support member 45 by an upper link member 96 and a lower link member 97. The upper link member 96 is pivotally coupled to the back support 62 by a forward pivot mounting bracket 98 which is pivotally coupled to the upper link member 96 by a transversely extending pivot pin 99. The upper link member 96 is pivotally coupled to the backrest by a transversely extending pivot pin 100 which is pivotally carried in a rearward pivot mounting bracket 101. The lower link member 97 is pivotally coupled to the backrest 62 by a transversely extending pivot pin 103 which is carried in a forward pivot mounting bracket 104 secured to the backrest 62. The lower link member 97 is pivotally coupled to the rear support member 45 by a transversely extending pivot pin 105 which is pivotally carried in a rearward pivot mounting bracket 106.

The rearward pivot mounting brackets 101 and 106 are slideably mounted in the forward guide slot 65 in the rear support member 45, which is similar to the forward guide slot 65 in the rear support member 45 of the chair 1, for facilitating altering both the height of the backrest 62 above the seat 14 and the angle of inclination of the backrest 62 relative to the seat 14. By slideably urging the rearward pivot mounting brackets 101 and 106 towards or away from each other along the forward guide slot 65 the angle of the backrest relative to the seat 14 can be adjusted until the angle the backrest 62 makes with the seat 14 is at the desired angle.

In this embodiment of the invention third releasable securing means are provided for releasably securing the rearward pivot mounting brackets 101 and 106 in the forward guide slot 65 at a desired spacing, and at a desired height in order to secure the backrest 62 at the desired height, and at the desired angle of inclination relative to the seat 14. The third releasable securing means may be any suitable securing means, for example, releasable friction clamps or the like.

Otherwise the chair 95 and its use is similar to the chair 1 and its use.

While the thigh engaging means of the chairs have been described as comprising thigh engaging elements formed by distal portions of the corresponding thigh support elements which are pivotally connected to the remainder of the thigh support elements, while this is desirable, it is not essential. Other suitable thigh engaging elements may be provided, and indeed, in certain cases, the thigh engaging elements may be releasably engageable with the corresponding thigh support elements. Indeed, it will also be appreciated that the thigh engaging elements may be dispensed with.

It will also be appreciated that the foot support members, instead of being provided on a pivotal carrier element, any other suitable arrangement of foot support members may be provided. Indeed, it is envisaged that the foot support members may be provided in the form of stirrups, which could be suspended from a transversely extending bar, and it is also envisaged that where the foot support means are provided as foot support members, the foot support members could be pivotally coupled to any of the chairs in any other manner. It is also envisaged that the foot support members need not be pivotally coupled to the chairs. Additionally, it is envisaged that the foot support members may be provided to be adjustable forwardly and rearwardly of the chairs, as well as upwardly and downwardly relative to the chair.

It is also envisaged that as well as pivoting the carrier element of the foot support members 49 about the transverse pivot axis 52, the foot support members 49 may also be pivotally mounted on the pivot connector 50 to be pivotal about a vertical axis extending centrally through the pivot connector 50. This would allow the carrier element and in turn the foot support members 49 to twist about the vertical axis, so that a seated subject could extend one or both of their legs rearwardly to engage the foot support members 49 and could then twist left and right to stretch the muscles on the left or right side of the quad. Such twisting movement about the vertical pivot axis would not be excessive, but would in general amount to pivoting the foot support members 49 forwardly and rearwardly about the vertical axis through an angle of plus or minus twenty degrees relative to the normal transverse setting of the foot support members.

While the chairs have been described as comprising armrests, while this is desirable, it is not essential. It will also be appreciated that the armrests as well as being adjustable upwardly and downwardly, may also be configured to be adjustable inwardly and outwardly.

It will also be appreciated that the seat may be of any other suitable shape and construction.

While the ground engaging support for the chair has been described as comprising a single pod ground engaging support, any other suitable ground engaging support may be provided for the chair. It will be appreciated that while the base from which the single pod extends upwardly has been described as comprising five arms 7 extending outwardly from the base, any number of arms, may be provided. It will also be appreciated that in certain cases, the arms or any other base may be provided with or without castors. In some embodiments of the invention it is envisaged that the arms of the base or other suitable base, would merely be configured to directly engage the ground.

It will also be appreciated that the ground engaging foot support may be provided with any other suitable foot engaging means besides a foot support plate. For example, it is envisaged in certain cases that the foot support plate may be replaced with an open shoe type mechanism which would permit a subject to engage the relevant foot into the shoe type mechanism without having to do up or undo straps. Such a mechanism could include a retaining mechanism which would click into and click out of engagement for engaging the foot therein and releasing the foot therefrom.

It will also be appreciated that the foot support plate or other suitable mechanism for supporting and engaging the relevant foot of the subject in the ground engaging foot support may float within the ground engaging framework, so that a subject could actively move in and out of the stretch of the calf and hamstring muscles. If the foot support plate or other foot engaging and supporting mechanism were located in the ground engaging framework to be floatable, it will be readily understood that the foot support plate or other such foot engaging and supporting mechanism may also be configured to be releasably fixed in a desired position to provide a static single stretch of the calf and hamstring muscles.

It will also be appreciated that the forward and rearward parts of the ground engaging framework 78 of the foot support 77 may be configured to be pivotal towards and away from each other and lockable together in a desired angular configuration for altering the angle of the foot plate 79. Additionally, it is envisaged that the foot plate may be adjustable upwardly and downwardly on the ground engaging framework 78 so that the foot of the seated subject is supported at a level such that the angle at which the leg extends from the seat of the chair to the foot support 77 is adjustable up to a level where the leg extends from the seat to the foot support 77 substantially horizontally.

Needless to say, a pair of ground engaging foot supports may be provided, one for each foot of the subject in order to allow simultaneous stretching of the hamstring and calf muscles in both legs of the subject simultaneously.

It will also be appreciated that while a specific second urging means for urging the thigh support elements from the rest state rearwardly for exercising the adductor muscles have been descried, any other suitable second urging means may be provided. It will be appreciated that the rack and pinion drive may be operated by any other means besides a ratchet system, for example, a pneumatic or an hydraulic system, such as, for example, a self-contained mini pneumatic system or mini hydraulic system.

It will also be appreciated that the second urging means may be provided in the form of one or more springs, for example, torsion springs, which would spring urge the thigh support elements rearwardly from the rest state.

It will also be appreciated that while the first, second, third and fourth securing means have been described as comprising friction clamps, any other suitable securing means may be provided. For example, the respective securing means, may be provided by ratchets which would be provided for operating, for example, the pivot connector upwardly and downwardly along the guide track 53, for pivoting the central cross member 47 in the pivot connector 50, for urging the backrest along the guide track 65 and/or for urging the armrests upwardly and downwardly.

While the limit means for limiting the rearward pivoting of the thigh support elements from the rest state have been described as comprising respective limit stop members co-operable with corresponding limit slots in the pinions 35, any other suitable limit means may be provided. It will also be appreciated that the limit means may be configured for limiting the rearward pivotal movement of the thigh support elements from the rest state through an angle greater or less than 70°. Indeed, in certain cases, it is envisaged that the limit means may be configured to permit the thigh support elements to pivot through an angle of up to 90° from the rest state, while in other embodiments of the invention the limit means may be configured to limit the rearward pivotal movement of the thigh support elements from the rest state to an angle of 45°, and in other cases, the limit angle could be up to 60°.

It will also be appreciated that any suitable first urging means may be provided for urging the thigh support elements from the second downwardly extending state to the first state with the thigh support elements forming a substantially common plane with the central seat element, and it is also envisaged that the first urging means may be provided by a ratchet mechanism for urging the corresponding thigh support element from the first state to the second state, and a quick release mechanism may be provided with the ratchet mechanism for returning the corresponding thigh support element to the first state, or vice-versa.

While the chair has been described as being suitable for use as an office chair, it will be readily apparent to those skilled in the art that the chair may be used in many other situations, for example, the chair according to the invention could be adapted as an airplane seat, a bus or train seat, a car seat, and needless to say, where adapted as an airplane, bus or train seat, the chair would be provided without castors. Needless to say, it will be readily apparent to those skilled in the art that irrespective of the use to which the chair is put, be it to use as an office chair, a dining chair, a resting chair, an airplane, bus or train seat, or any other seat or chair, the chair according to the invention may be provided either with or without castors, and may be provided with any other suitable base besides that described.

While the different embodiments of the chair which have been described with reference to the drawings have been described with various different features, it will be appreciated that features from one or more of the embodiments of the chairs may be incorporated into other ones of the chairs.

The invention claimed is:

1. A chair comprising:

a ground engaging support, a seat supported on the ground engaging support for engaging the buttocks of a subject seated thereon, a pair of foot support means located on respective opposite sides of the chair and generally rearwardly of the seat, each foot support means being configured for supporting a corresponding foot or ankle area of a subject seated on the seat with the corresponding thigh of a subject extending generally downwardly towards the knee from the seat and the corresponding lower leg of the subject inclining upwardly from the knee towards the foot support means for stretching of the quadriceps and hip flexor muscles, a rear support member located rearwardly of the seat and extending in a generally upwardly direction from the ground engaging support, and an adjustable connecting means slideably engageable with the rear support member adjustably connecting the foot support means to the rear support member, so that the level of the foot support means is adjustable relative to the level of the seat.

2. A chair as claimed in claim 1 in which each foot support means is located to the rear of the seat.

3. A chair as claimed in claim 1 in which the foot support means are pivotally connected to the chair about a transverse pivot axis, and are pivotal about the transverse pivot axis in a generally forwardly rearwardly direction relative to the seat.

4. A chair as claimed in claim 3 in which a second releasable securing means is provided for releasably securing the foot support means at a desired angular position about the transverse pivot axis.

5. A chair as claimed in claim 1 in which the adjustable connecting means is slideable on the rear support member in a generally upwardly downwardly direction for adjusting the level of the foot support means relative to the level of the seat.

6. A chair as claimed in claim 1 in which the level of the foot support means is adjustable relative to the level of the seat between a maximum lower level below the level of the seat and a maximum upper level above the level of the seat.

7. A chair as claimed in claim 6 in which the maximum lower level of the foot support means below the level of the seat is one of approximately 400 mm, approximately 350 mm, approximately 300 mm, and the maximum upper level of the foot support means above the level of the seat is one of approximately 100 mm, approximately 125 mm, and approximately 150 mm.

8. A chair as claimed in claim 1 in which each foot support means is configured for engaging the instep of the corresponding foot of a seated subject.

9. A chair as claimed in claim 1 in which each foot support means comprises a foot support member extending transversely from the corresponding side of the chair.

10. A chair as claimed in claim 1 in which the foot support means are carried on a carrier element, the carrier element being coupled to the rear support member by the adjustable connecting means, and, the foot support means extending from the carrier element on respective opposite sides thereof.

11. A chair as claimed in claim 1 in which the seat comprises a central seat element, and a pair of thigh support elements coupled to the central seat element and extending outwardly therefrom.

12. A chair as claimed in claim 11 in which the thigh support elements are alignable with the central seat element in a first state with the thigh support elements and the central seat element defining a substantially common plane, and each thigh support element is pivotal relative to the central seat element from the first state about a corresponding substantially horizontal first pivot axis through a downward arc for accommodating the corresponding thigh of a subject seated on the seat during stretching of the corresponding quadriceps and hip flexor muscles.

13. A chair as claimed in claim 12 in which a first retaining means is provided for retaining each thigh support element in a desired angular position about the corresponding first pivot axis.

14. A chair as claimed in claim 12 in which a first urging means is provided for urging each thigh support element about the corresponding first pivot axis in one or both of a generally upwardly direction and a generally downwardly direction, and advantageously, each first urging means comprises a resilient first urging means.

15. A chair as claimed in claim 11 in which the respective thigh support elements are pivotal about respective substantially vertically extending second pivot axes relative to the central seat element from a rest position through respective arcs in a generally rearwardly direction relative to the central seat element.

16. A chair as claimed in claim 15 in which a second urging means comprises a rack and pinion drive, and preferably, each thigh support element comprises a corresponding pinion, and the rack of the rack and pinion drive engages the respective pinions for simultaneously urging the thigh support elements about the respective second pivot axes.

17. A chair as claimed in claim 15 in which the thigh support elements are pivotal relative to the central seat element from the rest position with the respective thigh support elements cooperating with the central seat element to form the seat, in the generally rearwardly direction about the respective second pivot axes for supporting the thighs of a subject seated on the seat for stretching the muscles, and preferably, the central seat element is of substantially saddle shape having a pair of opposite side edges converging in a generally forwardly direction, and the thigh support elements extend along the respective converging side edges of the central seat element, and extend substantially forwardly therefrom in the rest position.

18. A chair as claimed in claim 15 in which a second retaining means is provided for retaining each thigh support element in a desired angular position about the corresponding second pivot axis.

19. A chair as claimed in claim 15 in which a second urging means is provided for urging the thigh support elements about the respective second pivot axes.

20. A chair as claimed in claim 11 in which an inner thigh engaging means is provided on each thigh engaging element for engaging an inner portion of a corresponding thigh supported thereon, each inner thigh engaging means is moveable between an inactive state lying in the plane defined by the corresponding thigh support element, and an active state extending substantially upwardly from the corresponding thigh support element for engaging an inner portion of a thigh supported on the corresponding thigh support element.

21. A chair as claimed in claim 20 in which each inner thigh engaging means is pivotally coupled to the corresponding thigh support element about a substantially horizontal third pivot axis when the thigh support element is in the rest position, and is pivotal about the third pivot axis between the inactive state and the active state.

22. A chair as claimed in claim 1 in which a backrest is provided for supporting the back of a subject seated on the seat, and preferably, the backrest extends generally upwardly relative to the seat, and advantageously, the backrest is adjustably coupled to the chair, and preferably, the backrest is adjustable upwardly and downwardly relative to the seat, and advantageously, a third releasable securing means is provided for releasably securing the backrest to the chair at a desired level relative to the seat, and preferably, the backrest is adjustably coupled to the chair for facilitating adjustment of the angle of the backrest relative to the seat, and advantageously, a releasable fixing means is provided for releasably securing the backrest to the chair at a desired angle relative to the seat, and preferably, the backrest is coupled to the rear support member, and advantageously, a pair of armrests are provided on respective opposite sides of the chair, and preferably, the armrests are connected to the rear support member, and advantageously, the armrests are adjustably connected to the rear support member, and are adjustable upwardly and downwardly relative to the level of the seat, and preferably, a fourth releasable securing means is provided for releasably securing the armrests at a desired level relative to the seat.

23. A chair as claimed in claim 1 in which a ground engaging footrest is provided for engaging and supporting one of the feet of a seated subject for facilitating stretching of the glute, hamstring and calf muscles.

24. A chair as claimed in claim 1 in which a first releasable securing means is configured for releasably securing the adjustable connecting means to the chair with the foot support means at a desired level relative to the level of the seat.

* * * * *